US011304541B2

(12) United States Patent
Thrift et al.

(10) Patent No.: US 11,304,541 B2
(45) Date of Patent: Apr. 19, 2022

(54) ELEVATOR HEIGHT ADJUSTMENT

(71) Applicant: KIDS2, INC., Atlanta, GA (US)

(72) Inventors: David Thrift, Alpharetta, GA (US); Stephen Burns, Cumming, GA (US); Jacob Sclare, Dacula, GA (US); Yuk Tong Poon, Yuen Long (HK)

(73) Assignee: KIDS2, INC., Atlanta, GA (US)

( * ) Notice: Subject to any disclaimer, the term of this patent is extended or adjusted under 35 U.S.C. 154(b) by 74 days.

(21) Appl. No.: 16/576,029

(22) Filed: Sep. 19, 2019

(65) Prior Publication Data

US 2020/0008585 A1 Jan. 9, 2020

Related U.S. Application Data

(63) Continuation-in-part of application No. 15/134,710, filed on Apr. 21, 2016, now Pat. No. 10,477,981.
(Continued)

(51) Int. Cl.
*A47D 13/06* (2006.01)
*E04H 17/00* (2006.01)
(Continued)

(52) U.S. Cl.
CPC ..... *A47D 13/068* (2013.01); *A47D 13/06* (2013.01); *A47D 13/063* (2013.01); *E04H 17/00* (2013.01);
(Continued)

(58) Field of Classification Search
CPC ..... A47D 13/068; A47D 13/063; A47D 7/03; A47D 13/02; A47D 13/01; A47D 7/02;
(Continued)

(56) References Cited

U.S. PATENT DOCUMENTS 3,309,719 A * 3/1967 Bader ..... A47D 11/007 5/98.1
7,661,157 B2 2/2010 McCluskey et al.
(Continued)

FOREIGN PATENT DOCUMENTS

CN 101836804 A 9/2010
EP 1987743 A1 11/2008
(Continued)

OTHER PUBLICATIONS

Extended European Search Report for EP App. No. 19202169; dated Nov. 21, 2019; 8 pgs.

*Primary Examiner* — David R Hare
*Assistant Examiner* — Madison Emanski
(74) *Attorney, Agent, or Firm* — Gardner Groff & Greenwald, PC

(57) ABSTRACT

A depth-adjustable fabric liner for removable attachment to a structural support fame for use as a child containment device. In example forms, the depth-adjustable fabric liner provides for adjustability to the depth of the floor or bottom of the liner such that the bottom or floor portion of the liner is adjustable between at least two different heights. In example forms, the depth-adjustable fabric liner is adjustable relative to the structural support frame between a first floor position, a second floor position, and a third floor position such that the child containment device is generally convertible between a play yard configuration, a sleeper/bassinet configuration, and a diaper changing station configuration. In some example forms, the liner is substantially elastic and stretchable.

17 Claims, 18 Drawing Sheets

Related U.S. Application Data

(60) Provisional application No. 62/152,845, filed on Apr. 25, 2015, provisional application No. 62/215,943, filed on Sep. 9, 2015, provisional application No. 62/745,668, filed on Oct. 15, 2018.

(51) Int. Cl.
*A47D 13/02* (2006.01)
*A47D 11/00* (2006.01)

(52) U.S. Cl.
CPC ..... *A47D 11/00* (2013.01); *A47D 13/02* (2013.01); *A47D 13/061* (2013.01); *A47D 13/066* (2013.01)

(58) Field of Classification Search
CPC .. A47D 13/066; A47D 13/065; A47D 13/021; A47D 13/06; A47D 13/061; A47D 11/00; E04H 17/00
See application file for complete search history.

(56) References Cited

U.S. PATENT DOCUMENTS

| | | | | |
|---|---|---|---|---|
| 8,001,630 | B2 | 8/2011 | Burkholder et al. | |
| 8,291,530 | B2 | 10/2012 | Burkholder et al. | |
| 8,316,481 | B2 | 11/2012 | Arnold, IV et al. | |
| 8,566,988 | B2 | 10/2013 | Son et al. | |
| 8,806,673 | B2 | 8/2014 | Burkholder et al. | |
| 8,893,325 | B2 | 11/2014 | Arnold, IV et al. | |
| 9,226,595 | B2 | 1/2016 | Jackson | |
| 9,351,586 | B2 | 5/2016 | Burkholder et al. | |
| 9,414,694 | B2 | 8/2016 | Arnold, IV et al. | |
| 9,706,855 | B2 | 7/2017 | Arnold, IV et al. | |
| 9,861,209 | B2 | 1/2018 | Arnold, IV et al. | |
| 9,901,187 | B2 | 2/2018 | Burkholder et al. | |
| 2010/0162485 | A1 | 7/2010 | McCluskey | |
| 2012/0042447 | A1 | 2/2012 | You et al. | |
| 2012/0211713 | A1 | 8/2012 | You et al. | |
| 2014/0159410 | A1* | 6/2014 | Rasmussen | A47C 17/34 296/24.33 |
| 2018/0070739 | A1 | 3/2018 | Arnold, IV et al. | |

FOREIGN PATENT DOCUMENTS

| | | | | |
|---|---|---|---|---|
| EP | 3085574 | A1 | 10/2016 | |
| FR | 2604345 | A1 | 4/1988 | |
| WO | WO-2016036914 | A1 * | 3/2016 | A47D 13/063 |

* cited by examiner

ELEVATOR HEIGHT ADJUSTMENT

CROSS-REFERENCE TO RELATED APPLICATIONS

This application claims priority to U.S. Provisional Patent Application Ser. No. 62/745,668 filed Oct. 15, 2018, and this application is a continuation-in-part of U.S. Non-provisional patent application Ser. No. 15/134,710 filed Apr. 21, 2016, which claims priority to U.S. Provisional Patent Application Ser. No. 62/152,845 filed Apr. 25, 2015, and U.S. Provisional Patent Application Ser. No. 62/215,943 filed Sep. 9, 2015, the entireties of all of which are hereby incorporated herein by reference for all purposes.

TECHNICAL FIELD

The present disclosure relates generally to the field of infants' and children's accessories, and more particularly to systems and methods for raising and lowering support surfaces of baby gear such as play yards, sleepers, diaper-changing stations, and other fabric-walled enclosures for infants and children.

BACKGROUND

Play yards are often used by parents and caregivers to provide a partially contained space for an infant or child to rest and play. Typically, a play yard includes a structural frame supporting a floor panel and sidewalls surrounding the contained space. Additional accessories such as a bassinet, changing table, and/or storage compartments can optionally be mounted to or supported by a play yard. Typically, play yards only function as a play yard, but can be configured with additional accessories, for example to provide a second floor panel or surface that is generally offset from the floor panel of the play yard, or can receive additional accessories that are generally coupled to the play yard.

There are some play yards with support surfaces and with mechanisms for raising and lowering the support surfaces. However, known elevator mechanisms can be problematic in several ways. These elevator systems generally result in the play yard having more components, higher cost, more complicated assembly, and complicated operation. They also create challenges with fabric bunching and wrinkling, or excess fabric creating a tripping hazard. Additionally, the user has to bear the weight of the support surface (and/or infants and/or objects supported by the surface) during the raising and lowering. Further, they provide a finite number of discrete height positions (due to their lock-and-key mechanisms). And the enclosure sides are typically either too sheer for sleep or not sheer enough to provide sufficient parent-to-child visibility during play.

Accordingly, it can be seen that needs exist for continuing improvements in this field of endeavor. It is to the provision of an elevator height adjustment system and method meeting these and other needs that the present disclosure is primarily directed.

SUMMARY

In example embodiments, the present disclosure provides a depth-adjustable fabric liner for coupling engagement with a structural support frame for use as a child containment device. In example forms, the depth-adjustable fabric liner provides for adjustability of the depth of the floor or bottom of the liner such that the bottom or floor portion of the liner is adjustable between at least two different heights. In example forms, the depth-adjustable fabric liner is adjustable relative to the structural support frame between a first floor position, a second floor position, and a third floor position such that the child containment device is generally convertible between a play yard configuration, a bassinet configuration, and a sleeper configuration.

In one aspect, the present disclosure relates to a depth-adjustable fabric enclosure for use with a structural support frame, the depth adjustable fabric enclosure including a sidewall enclosure and a floor panel. In one example form, the sidewall enclosure and the floor panel are coupled together to form a liner defining an internal containment volume therein, and the liner can be coupled to the structural support frame such that the liner can be positionable between two or more configurations.

In example forms, the two or more configurations can be in the form of a play yard configuration, a bassinet configuration, and/or a sleeper configuration. In example forms, at least one of the sidewall enclosure and the floor panel are generally formed from a substantially elastic and stretchable fabric. In example forms, in the play yard configuration, the floor panel of the liner is positioned at a first floor position. In the bassinet configuration, the floor panel of the liner is positioned at a second floor position. In the sleeper configuration, the floor panel of the liner is positioned at a third floor position.

In example forms, the sidewall enclosure includes a pair of connected side and end panels. Optionally, the upper portions of the side and end panels of the liner can define one or more flap portions for extending over cross-members of the structural support frame to support the liner. In some example forms, a separate sleeve is provided for permanent or removable engagement with the cross-members of the structural support frame, and wherein the liner can be permanently or removably connected to the sleeve. Optionally, one or more fastening members are coupled to the side and end panels or the floor panel for removable coupling engagement with the structural support frame. Optionally, a mattress is provided for insertion within the liner in contact with at least a portion of the floor panel. In some example forms, the mattress is segmented and foldable, and one or more segments of the mattress can be folded or unfolded to decrease or increase a surface area thereof to accommodate placement within the liner in the two or more configurations.

In another aspect, the disclosure relates to a child containment device including a structural support frame and a liner. The structural support frame includes a plurality of corner posts and a plurality of cross-members extending between the corner posts. The liner is removably attached to the structural support frame, and the liner includes a sidewall enclosure extending between the corner posts of the frame and a floor panel engaged with the side and end wall panels. The sidewall enclosure and the floor panel generally define an internal containment volume.

In example forms, the child containment device is convertible between a play yard configuration, a bassinet configuration, and/or a sleeper configuration. In the play yard configuration, the floor panel of the liner is positioned at a first floor position. In the bassinet configuration, the floor panel of the liner is positioned at a second floor position. In the sleeper configuration, the floor panel of the liner is positioned at a third floor position. In one example form, the liner is formed from a single piece of fabric. In another example form, the liner is formed from two or more pieces of fabric. In one example form, the liner is substantially stretchable and resilient. In another example form, the liner is inelastic and non-stretchable.

Optionally, the liner can be formed from a combination of substantially stretchable and elastic fabrics and semi-stretchable fabrics. Optionally, the liner can be formed from a combination of stretchable, elastic fabrics and inelastic, non-stretchable fabrics. According to some example forms, the stretchable and elastic fabric is substantially resilient.

Optionally, an upper portion of the liner includes a flap portion integrally connected to and foldable relative to the liner for folding around at least a portion of the structural support frame. In example forms, the flap portion is in the form of one or more extensions of the sidewall enclosure. In example forms, convertibility between the two or more configurations is provided by one or more folds of the flap portion to reduce the allowable extension of the panels and thus raise the height of the floor panel. Optionally, one or more fastening members are provided generally near the floor panel for removable attachment to portions of the corner posts, and convertibility between the two or more configurations is provided by moving the position of attachment of the fastening members with the corner posts. Optionally, a mattress is provided for fitting engagement within the liner and in contact with the floor panel. In some forms, the mattress includes one or more foldable panels or segments. Preferably, the mattress can be folded and/or repositioned within the liner and positioned against the floor panel to accommodate fitting engagement with the liner in one or more of the configurations.

In yet another aspect, the disclosure relates to a child containment device including a structural frame and a depth-adjustable fabric enclosure connected to the structural frame. The structural frame includes a plurality of corner posts and a plurality of cross-members extending between the corner posts. The depth-adjustable fabric enclosure includes a sidewall enclosure and a floor panel. In example forms, the floor panel of the depth-adjustable fabric enclosure can at least be positioned between two or more heights to define two or more configurations of the child containment device.

Other embodiments include a child-containment device including a structural frame and a depth-adjustable (aka elevator height adjustment) enclosure having a support surface and peripheral walls that are supported by the frame, configured in an overlapping/double-walled arrangement, and vertically slidable relative to each other (one up and the other down) to reposition the support surface between multiple depth/height positions with each position defining a different use configuration for example a play yard configuration, a sleeper/bassinet configuration, and a diaper-changing station configuration. A handle and/or lock/retainer can be provided for manually grasping/moving and releasably securing the support surface in a desired one of the vertical positions.

Still other embodiments include a display stand including a structural frame and an elevator height adjustment mechanism having a support surface and peripheral walls that extend downward from the support surface and that are vertically slidable relative to each other (one up and the other down) to reposition the support surface between multiple height positions forming for example a lowered/stored configuration and a raised/use configuration. In example embodiments, the display stand is configured for supporting a computer monitor, a television, or another electronic device. A handle and/or lock/retainer can be provided for manually grasping/moving and releasably securing the support surface in a desired one of the vertical positions.

And still other embodiments include a window shade device including a structural frame and an elevator height adjustment shade panel for repositioning between multiple height positions forming different lighting configurations each allowing a different amount of light to pass through or around the shade panel. A handle and/or lock/retainer can be provided for manually grasping/moving and releasably securing the shade panel in a desired one of the vertical positions.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the example embodiments are exemplary and explanatory of preferred embodiments, and are not restrictive of the invention, as claimed.

BRIEF DESCRIPTION OF THE DRAWINGS

FIG. 35 is a side view of the window shade of FIG. 34, viewed from inside an enclosed space and looking out, in a first configuration for allowing more light to pass through.

FIG. 36 shows the window shade of FIG. 35 in a second configuration for allowing less light to pass through.

DETAILED DESCRIPTION OF EXAMPLE EMBODIMENTS

Figure 1:
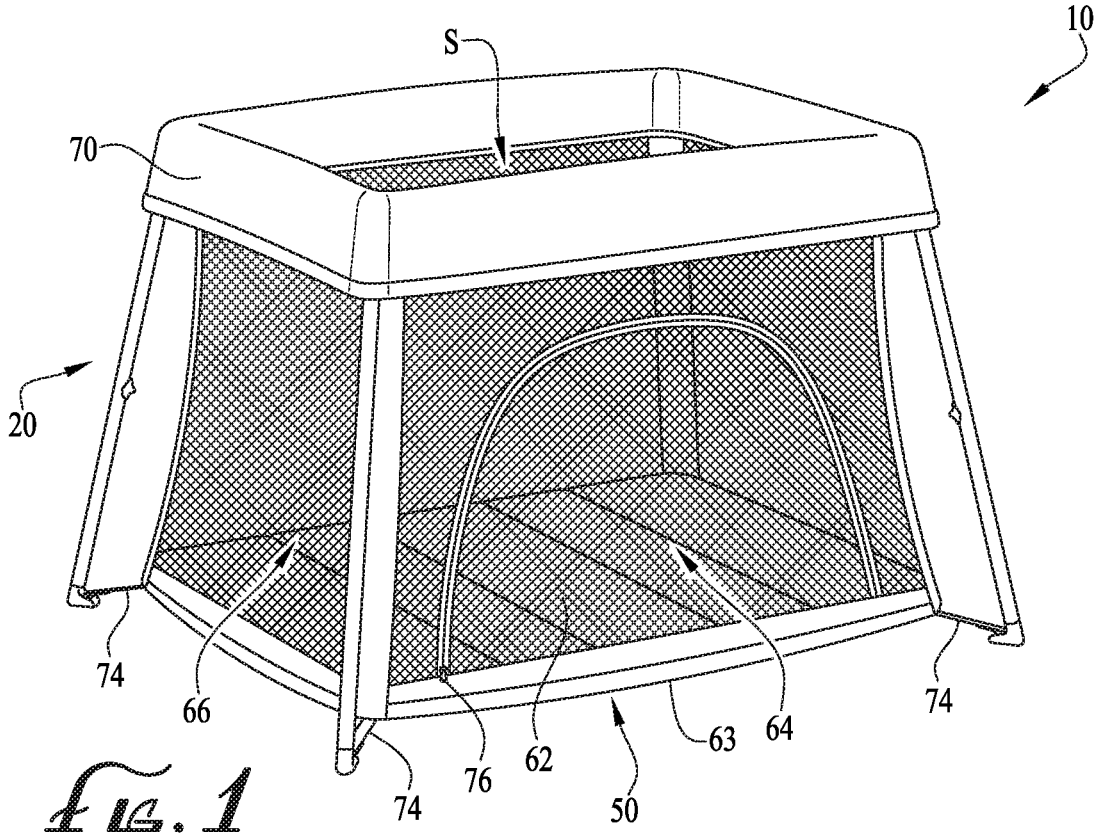
FIG. 1 is a perspective view of a play yard having a depth-adjustable fabric enclosure according to an example embodiment, showing the play yard in an expanded use configuration and a floor portion of the depth-adjustable fabric is positioned at a first floor position.

The present disclosure may be understood more readily by reference to the following detailed description of example embodiments taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-8 show a child containment device comprising a structural support frame 20 and a depth-adjustable fabric enclosure or liner 50 generally attached to the frame 20. In example embodiments, the depth-adjustable liner 50 is configured for ease of removal from the frame 20, for example to clean and replace the liner in ordinary usage of the child containment device. In alternative embodiments, the liner 50 can be configured for permanent attachment to the frame 20. Preferably, the depth-adjustable fabric liner 50 is configured to provide for adjustment to the depth of the floor or bottom of the liner (e.g., providing a plurality of different heights), for example, such that a bottom or floor portion of the liner 50 is adjustable between at least two different heights. As will be described below, the floor of the depth-adjustable fabric liner is preferably adjustable relative to the frame 20 between a first floor position, a second floor position, and a third floor position, for example, such that the child containment device is generally convertible between a play yard configuration 10 (see FIGS. 1 and 6), a bassinet configuration 10' (see FIG. 7), and a sleeper configuration 10" (see FIG. 8).

Figure 2:
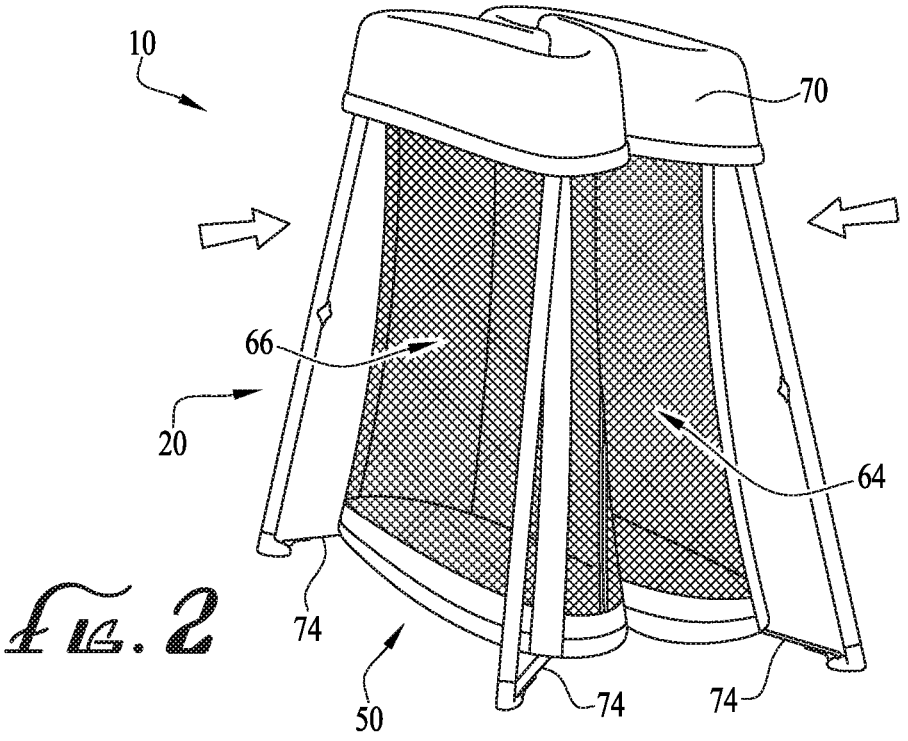
FIG. 2 is a perspective view of the play yard of FIG. 1, showing the play yard in a compact or folded configuration for storage and transport.

In example forms, with the liner 50 attached to the structural support frame 20, the play yard 10 can be configured in an expanded or unfolded configuration for use (see FIG. 1), or can be configured in a collapsed or folded configuration for storage or transport (see FIG. 2). In example embodiments, the frame 20 is constructed of substantially rigid tubing or bars formed of aluminum, steel, plastic or other structural material(s), and the liner 50 is constructed of polyester, cotton, or other natural or synthetic fabric or other flexible material(s). In example embodiments, as recited above, the liner 50 can preferably be either removably attached to the frame 20 or permanently attached thereto. For example, as will be described below, according to some example embodiments, the liner 50 is flexible and substantially stretchable and elastic such that the liner 50 can generally be configured so that the height of the floor or bottom portion of the liner 50 is adjustable between at least two different heights. The tubing or bars of the frame optionally comprise a round, oval, square, rectangular or other cross-sectional shape(s), and the liner attachments are compatible with frame members of different configurations. The liner 50 optionally includes one or more panels of mesh or other materials providing visibility and breathability through the liner. According to some example forms, the mesh or visibility material can be formed from a substantially elastic material. Optionally, one or more panels of the liner 50 can comprise one or more couplings or engagement members or mechanisms (e.g., zippers, clasps, clips, etc.) such that at least a portion of the panel(s) can be uncoupled to provide an opening or access therethrough (as will be described below).

Figure 3:
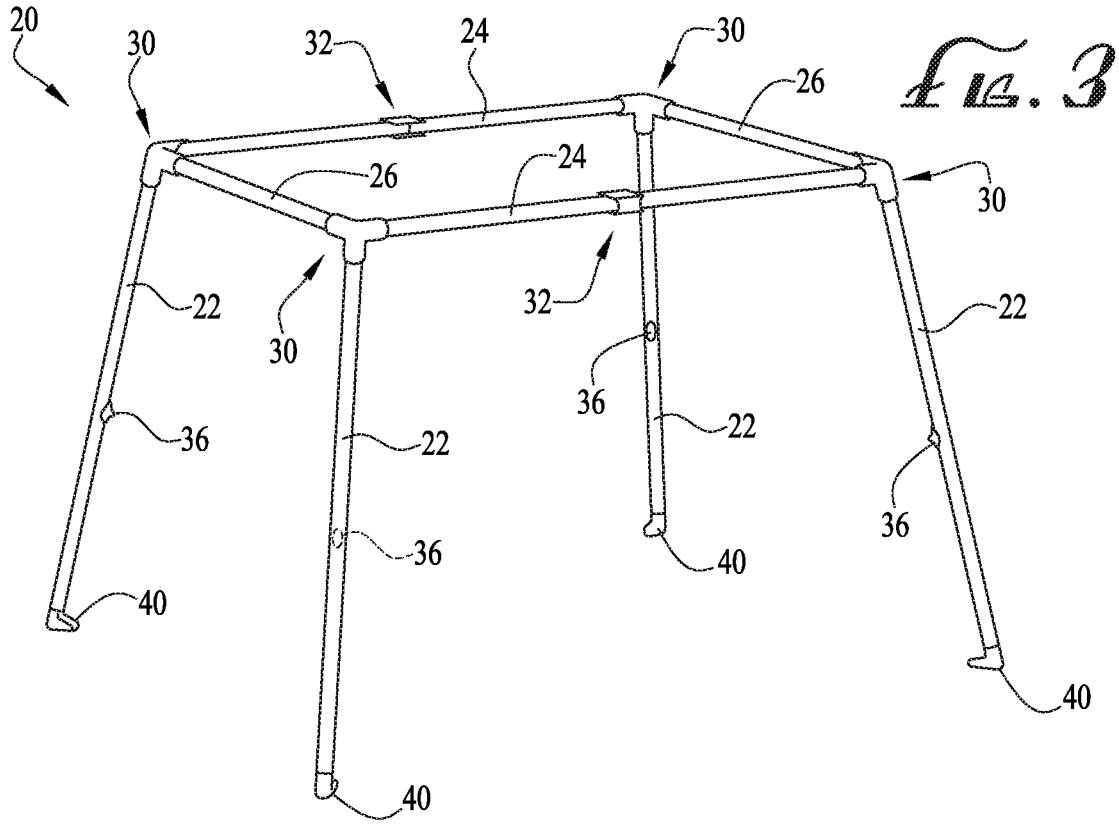
FIG. 3 is a perspective view of a support frame of the play yard of FIG. 1, wherein the support frame is in the expanded configuration.
Figure 4:
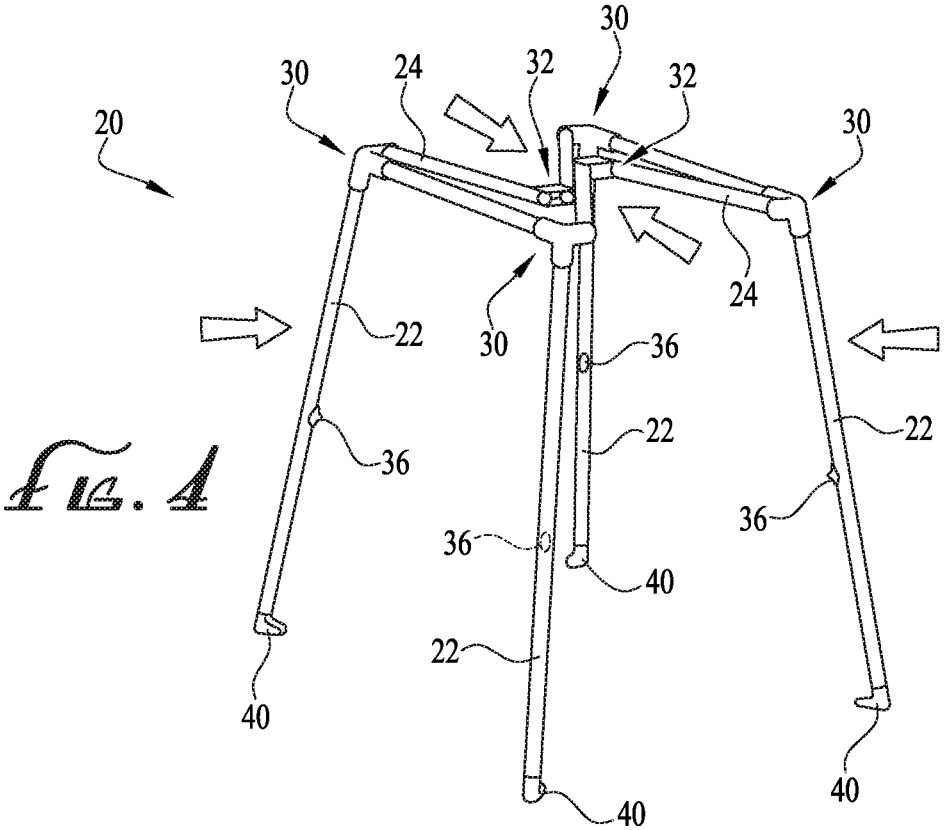
FIG. 4 is a perspective view of the support frame of FIG. 3, wherein the support frame is in the collapsed configuration.

As depicted in FIGS. 3-4, the frame 20 comprises four generally upright corner posts 22, first and second upper side cross-members 24, and first and second upper end cross-members 26, forming a generally rectangular three-dimensional housing bounding an internal contained volume or space S for structurally supporting the liner 50 to receive a child therein. In the depicted embodiment, the side cross-members 24 are longer than the end cross-members 26, defining a containment having a length greater than its width. In alternate embodiments, the length and width may be generally equal (e.g., forming a square or cubed three-dimensional housing), or the width can be greater than the length. In alternative embodiments, the three-dimensional housing can be shaped as desired, for example, wherein the three-dimensional housing cross-sectional shape (e.g., taken along a horizontal plane parallel with the support surface and generally coinciding with the cross-members 24, 26) can be generally oval, circular, triangular, or otherwise shaped as desired. Optionally, the assembly of the frame (e.g., corner posts 22, first and second upper side cross-members 24, and first and second upper end cross-members 26) an be shaped and connected as desired, for example, to form a desirable three-dimensional shape to provide for permanent or removable connection between the corner posts 22, the first and second upper side cross-members 24, and the first and second upper end cross-members 26. In some example forms, the corner posts 22 and/or the cross-members 24, 26 are at least partially curved or radiused, for example, to provide a desired three-dimensional housing.

In example embodiments, the frame 20 is collapsible or foldable for more efficient storage and transport when not expanded and set up for use. For example, in the depicted embodiments, first and second ends of the side cross-members 24 are pivotally connected by hinged or pivotal end coupling joints 30 to upper ends of the corner posts 22. The ends of the cross-members 26 are generally fixedly engaged with the coupling joints 30, for example, so that they do not pivot relative to the coupling joints 30. Thus, according to example forms, the end coupling joints 30 are configured such that the first and second ends of the side cross-members 24 are pivotally coupled to the end coupling joints 30 and the first and second ends of end cross-members 26 are fixedly engaged with the end coupling joints 30. However, according to other example forms, the ends of the end cross-members 26 can be pivotally connected to the end coupling joints 30. The side cross-members 24 optionally also include hinged or pivotal medial coupling joints 32 about midway along their lengths. One or more of the coupling joints 30, 32 are optionally lockable to releasably retain the frame in the expanded and/or folded configurations, for example latching or locking when opened into the expanded configuration (FIG. 3), and requiring manual actuation by an adult caregiver to release the frame for folding (FIG. 4) and prevent inadvertent folding by a child contained in the play yard 10. Thus, in example embodiments, the frame 20 is foldable between the expanded configuration (FIG. 3) and the collapsed configuration (FIG. 4) with the liner 50 installed or removed.

In the depicted embodiment, the corner posts 22 generally extend at least partially outwardly, for example, from the coupling joints 30 to the ground surface (e.g., supporting the frame 20) to define a generally trapezoidal/pyramid frame. Optionally, the corner posts 22 are generally configured to extend substantially vertical (e.g., up and down). In one example form, the frame 20 can be configured to define a 2-dimensional generally trapezoidal shape when viewed from the sides or ends, for example, wherein the corner posts 22 generally extend at least partially outwardly in two dimensions. Optionally, in other example forms, the frame 20 can be configured to define a 3-dimensional pyramid-like (e.g., pyramidal-frustum) shape, for example, where the corner posts 22 generally extend outwardly from the coupling joints in three dimensions.

One or more of the corner posts 22 optionally includes a liner attachment loop 36 for receiving a strap or other attachment portion of the liner 50, for example at or adjacent the upper or medial portion of the post. The corner posts optionally further comprise base supports or feet 40 at lower ends thereof, which can optionally include wheels or casters for rolling support and repositioning of the play yard. In some example forms, one or more of the feet 40 generally comprise a rubberized or other high friction engagement portion, for example, so that the feet 40 (and thus the corner posts 22 and frame 20 thereof) remain generally engaged and grounded with a support surface, for example, a floor or other surface that the frame 20 is resting on. According to some example forms, the feet 40 preferably additionally provide for attachment with at least a portion of the liner 50, for example, to provide for fitting engagement of the liner 50 with the frame 20 (as will be described below).

In alternate example embodiments, the frame 20 can comprise an accessory mount, for example at or adjacent an upper end of the corner posts, for supporting a sleeper, bassinet, changing table, container or other accessories.

Furthermore, the frame 20 can optionally include one or more lower diagonal cross-members pivotally or hingedly connected at one end to the feet 40 or lower ends of the corner posts 22, and at the other end to a central base coupling hub, and wherein lateral side cross-members can optionally extend between adjacent lower diagonal cross-members, and may include support feet with pivotal or hinged couplings at or adjacent their midpoints, and pivotal and/or sliding couplings at ends thereof. U.S. patent application Ser. No. 15/047,912 is owned by the applicant, is incorporated herein by reference, and shows an example collapsible frame for a child containment device. Optionally, in alternate example embodiments, the frame can generally be a substantially rigid frame that is not foldable or collapsible.

According to some example forms, the frame 20 can optionally adjust up and down, for example, to increase or decrease the height of the upper side and end cross-members 24, 26. For example in some example forms, the corner posts 22 can be configured to provide for the adjustment in their length thereof, for example, by providing telescoping corner posts. In example forms, the telescoping corner posts can comprise one or more locking or adjustment members or clips such that an operator can easily adjust the length of the corner posts. Furthermore, according to some example forms, the upper side and end cross-members 24, 26 can be telescoping to provide adjustability to their respective lengths thereof.

Figure 5:
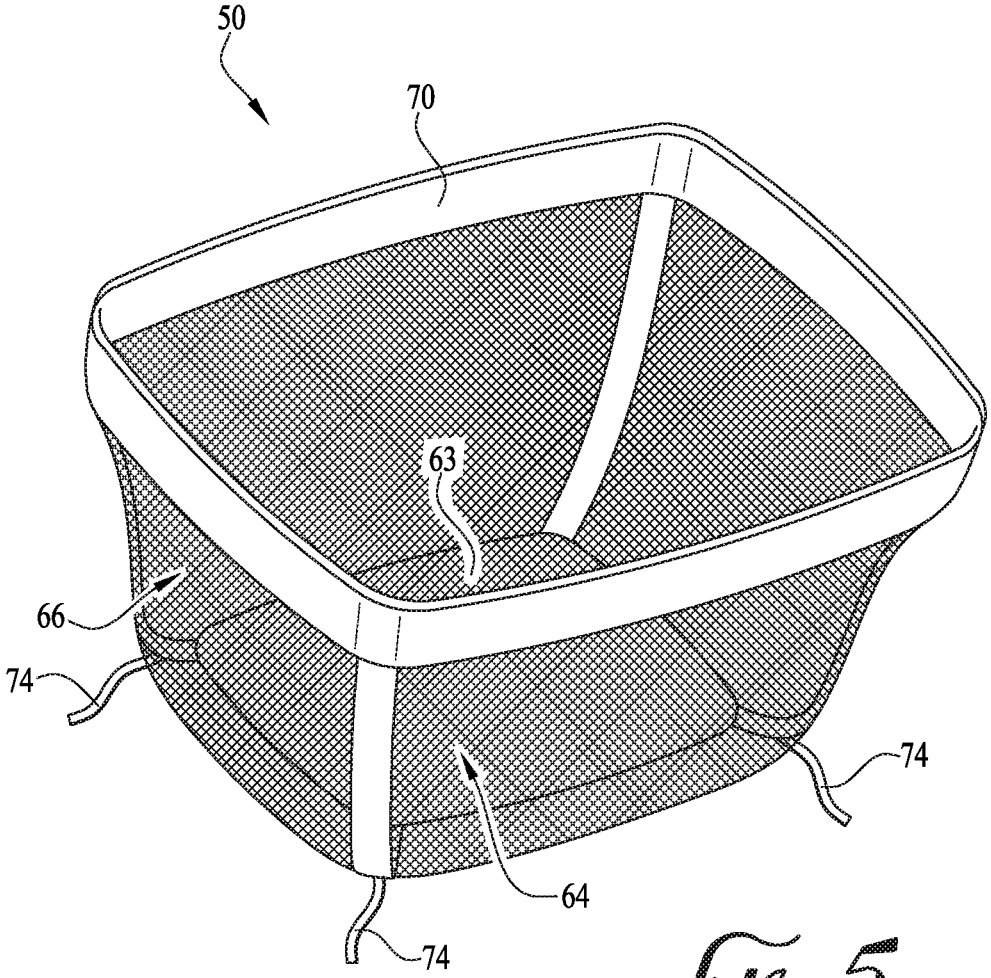
FIG. 5 is a perspective view of the depth-adjustable fabric enclosure of FIG. 1, wherein the depth-adjustable fabric enclosure is in a relaxed, natural, non-stretched state.

FIG. 5 shows the liner 50 in greater detail and removed from the frame 20. As depicted, the liner 50 is in a relaxed, unstretched state, and comprises a generally rectangular base or floor panel 63 and a sidewall enclosure. In example embodiments, the sidewall enclosure comprises first and second generally rectangular side wall panels 64, and first and second generally rectangular end wall panels 66. In example forms, an upper portion of the rectangular side wall panels 64 and the rectangular end wall panels 66 of the liner 50 can comprise a flap portion 70, which is positioned at the open end of the rectangular side wall panels 64 and the rectangular end wall panels 66, and which extends substantially around the entire upper periphery of the liner 50, for example, which can be folded outwardly around at least a portion of the side and end cross-members 24, 26 (and the end coupling joints 30 coupled therebetween). Thus, in example embodiments, the flap portion 70 is integral with the sidewall enclosure and is a portion of the side and end wall panels 64, 66. According to example embodiments, the flap portion 70 can be formed from a plurality of flap portions, for example, wherein each of the upper portions of the side and end wall panels 64, 66 comprise a flap portion, and wherein connection of the side and end wall panels 64, 66 (forming the sidewall enclosure) connects each of the flap portions together to define the flap portion 70. Optionally, a stiffening member or additional fabric portion can be provided with the flap portion 70, for example, to provide additional stiffness and rigidity of the flap portion 70. Optionally, the flap portion 70 (or multiple flap portions) can be removably mounted to an upper portion of the side and end wall panels 64, 66. In some example forms, one or more fasteners are provided for removable engagement of the flap portion 70 with one or more portions of the frame 20 and/or the liner 50. Optionally, the flap portion 70 comprises one or more inserts or coupling members or clips mounted thereto (or to a portion of the liner 50) for providing for coupling engagement with the frame 20 (or cross-members 24, 26).

In some example forms, one or more straps, loops, or other fastening members 74 extend from a portion of the liner 50, for example, generally at or near the base 63 (or side or end wall panels 64, 66) for coupling to the corner posts 22 of the frame 20, or for example, for coupling to the liner attachments (e.g., loops 36 and/or the feet 40) of the corner posts 22. In some example forms, the liner attachments can be provided by one or more clasps, clips or other connectors or couplings for connecting to and disconnecting from the fastening member 74 to provide for quick and secure coupling engagement with the frame 20 (or to one or more portions thereof) in the various configurations as described herein.

Figure 6:
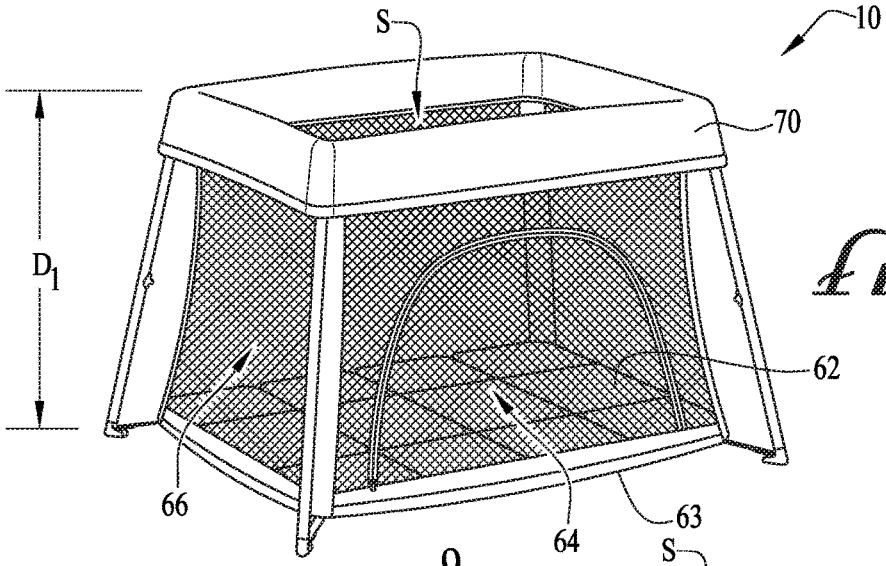
FIG. 6 is another perspective view of the play yard of FIG. 1.
Figure 7:
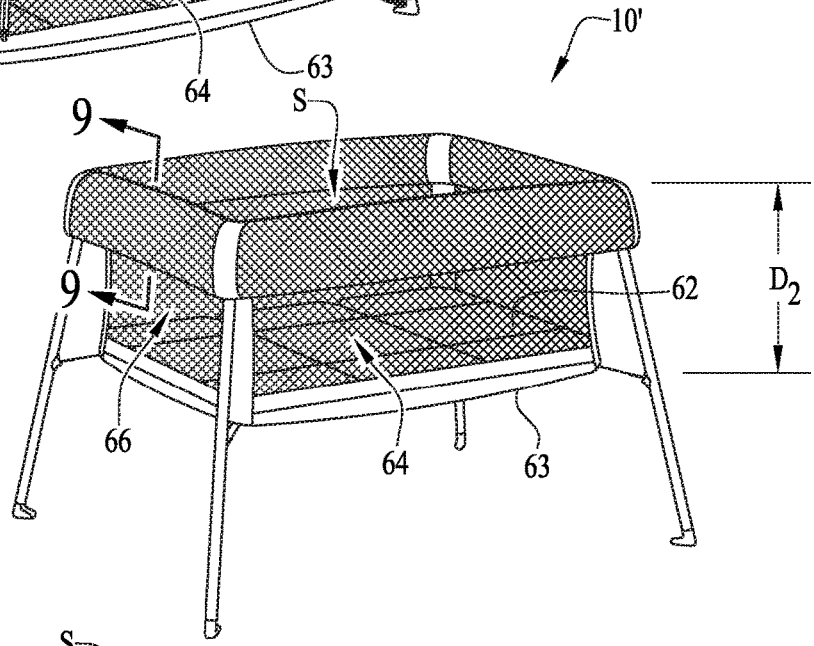
FIG. 7 is a perspective view of the play yard of FIG. 6, wherein the depth-adjustable fabric enclosure is configured as bassinet according to another example embodiment, with the floor of the depth-adjustable fabric enclosure positioned at a second floor position.
Figure 8:
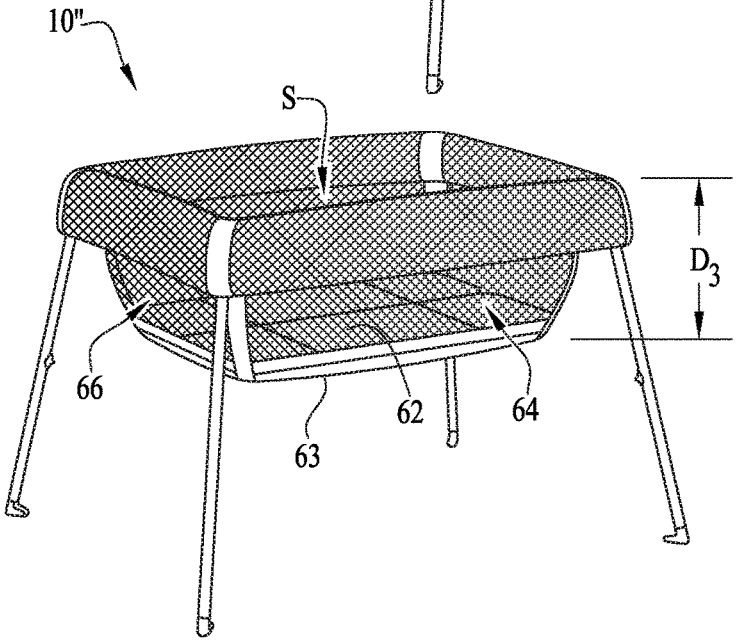
FIG. 8 is a perspective view of the play yard of FIG. 6, wherein the depth-adjustable fabric enclosure is configured as a sleeper, according to another example embodiment, with the floor of the depth-adjustable fabric enclosure positioned at a third floor position.

In example embodiments, the liner 50 is stretchable and elastic to provide for the convertibility between the two or more configurations (e.g., the play yard configuration 10 of FIGS. 1 and 6, the bassinet configuration 10' of FIG. 7 and the sleeper configuration 10" of FIG. 8). According to some example forms, the liner 50 is formed from a single piece of fabric, which is substantially stretchable and elastic, for example to accommodate a substantially large change in its size or dimensions to provide for convertibility between the configurations. Optionally, two or more single pieces of fabric are assembled together to form the liner 50. In example embodiments, about two or more pieces of inelastic, non-stretchable fabrics can be used to form the liner. Optionally, one or more pieces of inelastic fabric can be combined with one or more pieces of elastic fabric, for example, such that the liner is formed from a combination of both inelastic (not stretchable) and elastic (stretchable) fabrics. Further optional, one or more pieces of inelastic fabric can be combined with one or more pieces of semi-elastic fabric, or for example, the liner can be formed with one or more desired fabrics or other generally flexible sheet materials, or other woven materials, and wherein the elasticity and elastic deformation (e.g., stretchability) of the material (s) can be chosen as desired. In example embodiments, one or more pieces of fabric can be generally sewn, heat bonded or welded, glued, or otherwise attached together as desired. As shown in FIG. 5, the liner 50 is in its natural, unstretched state, which is substantially smaller than the liner 50 when it is coupled to the frame 20 and configured as a play yard 10. According to one example form, the liner 50 comprises one or more stretch fabrics, which can preferably provide for a 2-way and/or 4-way stretch, for example, so that the liner 50 is capable of being converted between the configurations to provide adjustment to the depth/height of the floor 63. Optionally, in other example forms, the fabric of the liner 20 can preferably be formed from other stretchable or elastic materials, or can be formed from a combination of materials (both stretchable and elastic and/or generally semi-elastic).

In example embodiments, the fabric is substantially resilient such that the liner 50 does not remain stretched after normal use, but instead generally retains its elasticity, for example such that the dimensions of the liner 50 in its relaxed, unstretched state are between about 15% to about 65% percent smaller than the dimensions of the liner 50 in its expanded configuration with the base positioned at a first floor position (see FIGS. 1 and 6). According to some example forms, the dimensions of the liner 50 in its relaxed, unstretched state are between about 20%-45%, more preferably about 35%, smaller than the dimensions of the liner 50 in its expanded configuration with the base 63 positioned at a first floor position (e.g., generally the maximum expansion of the liner 50). Thus, according to example embodiments, the liner 50 in its relaxed, unstretched state can be stretched (generally outwardly and by and outward, external force) such that the dimensions of the liner in the expanded configuration are generally between about 15%-65% larger than the dimensions of the liner 50 in the relaxed, unstretched state as depicted in FIG. 5. Preferably, the liner 50 comprises a sufficient amount of elasticity such that the liner 50 can be stretched and adjustable relative to the frame 20, for example, which can generally be trapezoidal or pyramid-shaped. Optionally, in other example embodiments, the liner 50 can be preferably shaped as desired, for example, generally comprising a circular, oval, elliptical or other cross-sectional shape, for example, and wherein the floor panel is generally shaped to match the cross-sectional shape. Optionally, a generally single side panel extends around the entire periphery and is generally coupled to the floor panel 63. Preferably, the floor panel 63 can be shaped as desired. In alternate example embodiments, the liner 50 can be configured to expand/retract similar to an accordion, for example, wherein a plurality of resilient folds facilitate in the expansion/retraction of the liner between the configurations.

FIGS. 6-8 show the child containment device in the play yard 10 configuration (see FIGS. 1 and 6), the bassinet 10' configuration (see FIG. 7), and the sleeper 10" configuration (see FIG. 8). In example embodiments, the child containment device (e.g., the structural support frame 20 and the liner 50) is convertible between the play yard 10, the bassinet 10', and the sleeper 10" configurations, for example, wherein the liner 50 is substantially stretchable and elastic (e.g., tensionable) such that when the liner 50 is coupled to the frame 20, the floor panel 63 of the liner 50 (or mattress portion 62 therein) can be positioned between a first floor position (play yard 10), a second floor position (bassinet 10'), and a third floor position (sleeper 10"). For example, as shown in FIG. 6, in the play yard configuration 10, a depth $D_1$ is defined between the upper perimeter of the child containment device (or flap 70) and the floor panel 63 (or mattress portion 62 therein), for example, which is generally between about 20-35 inches, more preferably between about 21-30 inches, for example between about 21-26 inches according to one example embodiment. According to example forms, when the child containment device is in the play yard configuration 10 with the liner 50 positioned in the first floor position, the base 63 of the liner 50 is generally in contact with the support surface or ground surface that is supporting the support frame 20. Optionally, according to other example embodiments, the frame 20 can comprise lower supports (see FIG. 20) on which the base 63 of the liner 50 can rest (e.g., causing the base 63 to become offset from the ground surface), or the liner 50 can generally be suspended and offset from the ground surface, for example, as shown in FIGS. 7 and 8.

As shown in FIG. 7, in the bassinet configuration 10', a depth $D_2$ is defined between the upper perimeter of the child containment device and the floor panel 63 (or mattress portion 62 therein), for example, which is generally between about 6-16 inches, more preferably between about 7-14 inches, for example between about 7.5-12 inches according to one example embodiment. As shown in FIG. 8, in the sleeper configuration 10", a depth $D_3$ is defined between the upper perimeter of the child containment device and the floor panel 63 (or mattress portion 62 therein), for example, which is generally between about 6-16 inches, more preferably between about 7-14 inches, for example between about 7.5-12 inches according to one example embodiment. Thus, in some example embodiments, the depth $D_3$ can be substantially similar to the depth $D_2$. Alternatively, the depth $D_3$ can be chosen as desired, for example, which can be generally less than the depth $D_2$. According to example embodiments, the internal containment volumes S of the play yard 10, bassinet 10', and sleeper 10" are generally different, for example, wherein the internal containment volume S of the play yard 10 is larger than the internal containment volumes S of the bassinet 10' and sleeper 10", wherein the internal containment volume S of the bassinet 10' is smaller than the internal containment volume S of the play yard 10 but generally larger than the internal containment volume S of the sleeper 10", and wherein the internal containment volume of the sleeper 10" is generally smaller than the internal containment volumes S of the play yard 10 and the bassinet 10'. Reference herein to the internal containment volume S is understood to mean the containment volume defined by the liner 50 in the respective configurations.

Figure 9:
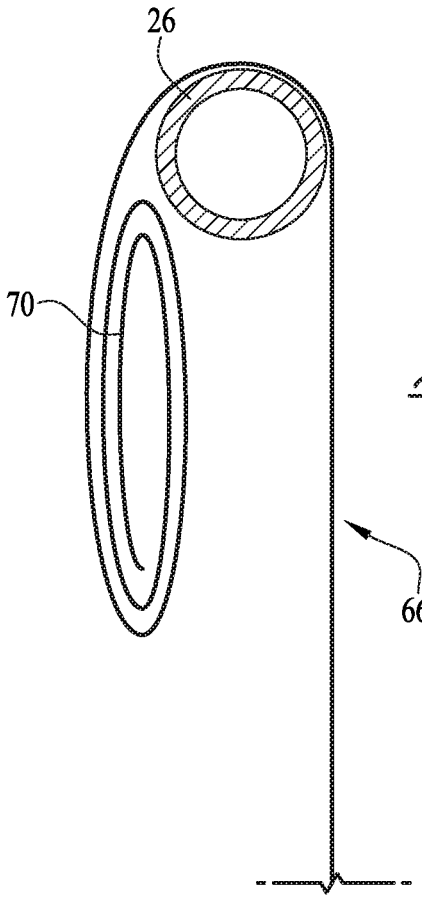
FIG. 9 shows a cross-sectional view of an upper portion of the depth-adjustable fabric enclosure folded and engaged with the support frame of FIG. 7 taken along line 9-9

As depicted in FIGS. 6-8, to convert the child containment device from the play yard configuration 10 to one of the bassinet or sleeper configurations 10', 10", the upper flap portion 70 is folded or rolled towards the panels 64, 66 such that at least a portion of the panels 64, 66 is generally folded and rolled up with the upper flap portion 70, and thus causing the floor panel 63 to generally raise from the ground surface to either of the second or third floor positions. For example, as depicted in FIGS. 7-8, at least a portion of the panels 64, 66 is generally rolled or folded with the upper flap portion 70 to cause adjustment to the height of the floor panel 63 (also see FIG. 9). According to some example forms, one or more fasteners can be provided for removably coupling the upper flap portion 70 to the frame 20 (or to a portion of the liner 50), or for example, for securing the rolled flap (e.g., comprising at least a portion of the panels rolled therewith) to the frame 20 or to a portion of the liner 50).

According to preferred example forms, the elasticity of the liner 50 additionally causes retraction of the liner 50, and thus a reduction to the internal containment volume S thereof, for example, which preferably assists in adjustment in the height of the floor panel 63. Optionally, in other example embodiments, the upper flap portion 70 remains generally folded at least partially around the upper side and end cross-members 24, 26, and the elasticity of the liner 50 generally solely causes adjustment to the internal containment volume S and the height of the floor panel 63 relative to the ground surface. As shown, in some example forms, one or more fastening members 74 can be provided with the liner 50 for quick and secure coupling engagement and disengagement with the liner attachments of the frame 20 (or to one or more portions thereof), for example, to generally position the floor panel 63 at a desirable height.

Figure 10:
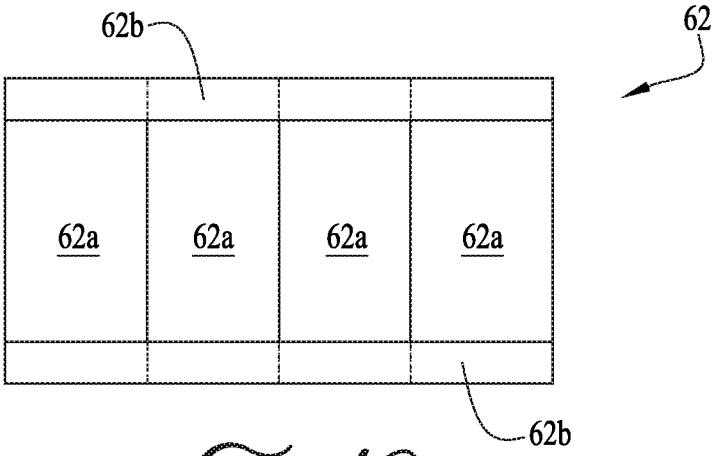
FIG. 10 is a top plan view of a mattress for use with the depth-adjustable fabric enclosure of FIG. 1 according to an example embodiment.

In example forms as described above, a floor platform or mattress 62 is optionally provided for placement on the floor panel 63 of the liner 50 within the contained space S bounded by the side walls 64 and end walls 66. In example forms, the mattress 62 generally comprises a plurality of foldable segments having internal cushioning and support, which preferably is generally foldable to accommodate convertibility between the configurations (e.g., play yard, bassinet and sleeper) and to facilitate storage or travel. For example, according to some example embodiments and as described above, at least some of the dimensions of the liner 50 are generally reduced or enlarged between configurations. As depicted in FIG. 10, the mattress panel 62 generally comprises a plurality of foldable panels or segments, for example, generally central rectangular segments 62*a*, and side rectangular segments 62*b*. In example forms, the segments 62*a*, 62*b* are generally configured to fold relative to each other, for example, to increase or reduce the surface area thereof such that the mattress 62 can be adapted to the size of the floor panel 63 based on the configuration of the child containment device. In example forms, the entire available surface area (e.g., no segments folded) of the mattress 62 is used in the play yard configuration 10. In the bassinet configuration 10', the side rectangular segments 62*b* are generally folded to lie underneath the central rectangular segments 62*a*, for example, as the dimensions of the base 63 of the liner 50 are generally at least partially smaller or reduced such that at least some of the surface area of the mattress 62 is generally removed.

Figure 11:
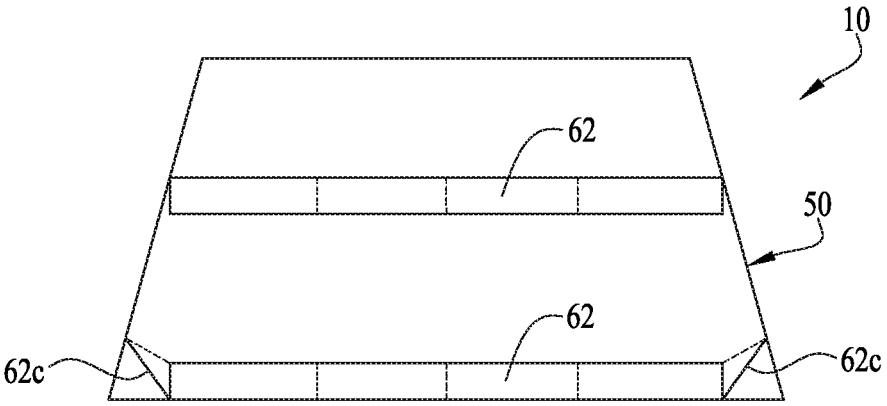
FIG. 11 is a side plan view of the depth-adjustable fabric enclosure and the mattress of FIG. 1, showing the movement and positioning of the mattress between the first and the second floor positions.

As depicted in FIG. 11, one or more gussets, wedges or flaps 62*c* can be incorporated with the liner 50, for example, to generally extend from one or more of the panels' 64, 66 edges of the liner 50 to the mattress 62 (or edges thereof). In some example forms, the flaps 62*c* can comprise internal cushioning and support as similarly described with respect to the mattress 62. In some example forms, the flaps 62*c* generally extend from the one or more panels of the liner 50 such that they generally engage or contact a bottom outer edge of the mattress 62. Optionally, the flaps can extend from the panels of the liner 50 such that they generally engage a top corner portion of the mattress 62, or for example, generally extending at least partially on a top surface of the mattress 62 (see dashed lines). Optionally, the flaps 62*c* can be configured as desired, for example, for connection with the mattress 62, or for engagement with the mattress 62 such that a generally smooth transition is provided therebetween.

In some example forms, the flaps 62*c* can be removable from the liner 50, or for example, the flaps 62*c* can be formed from different lengths, for example, such that a first flap comprising a first dimension is generally removably engaged with the liner 50 in the play yard configuration 10, but wherein a second flap comprising at least partially smaller dimension would be removably engaged with the liner 50 in the bassinet configuration 10'. Optionally, a third flap (comprising a generally smaller dimension than the second flap) could be provided for removable engagement with the liner 50 in the sleeper configuration 10". In other example embodiments, a flap 62*c* is generally provided for the bassinet and sleeper configurations 10', 10", but typically flaps are not needed for the play yard configuration 10, for example, wherein the dimensions of the mattress 62 are generally configured for engagement with the floor panel 63 and the bottom of the panels 64, 44 of the liner 50 near the floor surface 63. Thus, when the liner 50 is in a substantially stretched and expanded configuration (see FIG. 1), the mattress 62 is generally provided with a snug fit atop the floor 63 and the bottom portions of the panels 64, 66. However, according to other example embodiments, for example as depicted in FIG. 11, the liner 50 comprises one or more flaps 62*c* for abutment or engagement, or for example, generally in close proximity to the outer edges of the mattress 62 or a corner portion or top surface of the mattress 62. Thus, in some example forms, as depicted in FIG. 11, with the flap 62*c* removably engaged with the liner 50 (e.g., an internal surface of the liner bounding the internal containment volume S) at least one dimension of the mattress 62 remains the same between the play yard and bassinet configurations 10, 10'.

Figure 12:
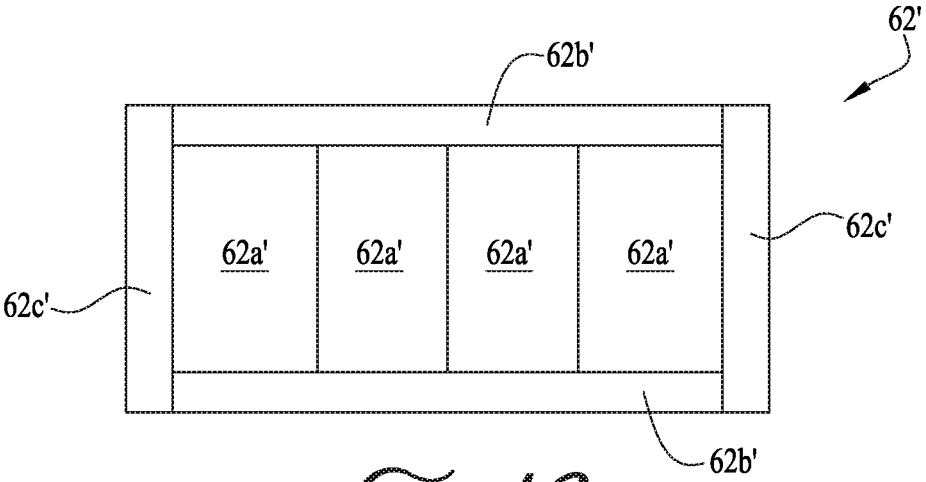
FIG. 12 shows a top plan view of a mattress for use with the depth-adjustable fabric enclosure of FIG. 1 according to another example embodiment.

In alternate example embodiments, as depicted in FIG. 12, a mattress 62' comprises a plurality of foldable panels or segments, for example, generally central rectangular segments 62*a*', side rectangular segments 62*b*' and end rectangular segments 62*c*'. In example forms, the segments 62*a*', 62*b*', and 62*c*' are generally configured to fold relative to each other, for example, to increase or reduce the surface area thereof such that the mattress 62' can be adapted to the size of the floor panel 63 based on the configuration of the child containment device (e.g., play yard, bassinet or sleeper). According to some example forms, one or more mattress panels are generally folded relative to each other such that the surface area of the mattress 62 is generally reduced, for example to engage the floor panel 63 in the bassinet configuration 10' or the sleeper configuration 10". In some example forms, the mattress 62 can generally be rotated 90 degrees before installation within the liner 50 and in contact with the floor surface 63, for example, for reconfiguring the mattress 62 from being used in the play yard configuration 10 (maximum surface area) to a configuration (e.g., bassinet or sleeper) where the floor surface 63 is generally not expanded or stretched as much, for example, which reduces the dimensions thereof. In some example forms, the mattress can be configured, for example, as described in U.S. patent application Ser. No. 14/021,934, which is owned by the applicant and shows a plurality of different mattress configurations, the entirety of which is incorporated herein by reference.

According to some example forms, some of the mattress panels (or at least portions of the panels) can be formed from a resiliently flexible material, or a combination of resilient and flexible materials, for example, such that a portion thereof can be substantially folded relative to another portion of the same panel. For example, as depicted in FIG. 12, the side and end rectangular segments 62*b*', 62*c*' can be configured to substantially fold, for example, when it is desirable to fold one or more of the segments 62*a*' relative to each other, or for example, by folding the side rectangular segments 62*b*' relative to the central rectangular segments 62*a*' (see dash lines indicating where the segments 62*b*', 62*c*' can be folded as desired. Optionally, a hinge or other pivotal member or coupling can be provided for allowing pivoting or folding of a portion of a segments relative to another, for example, which is generally how the segments 62*a*', 62*b*' and 62*c*' are generally foldably coupled together.

Figure 13:
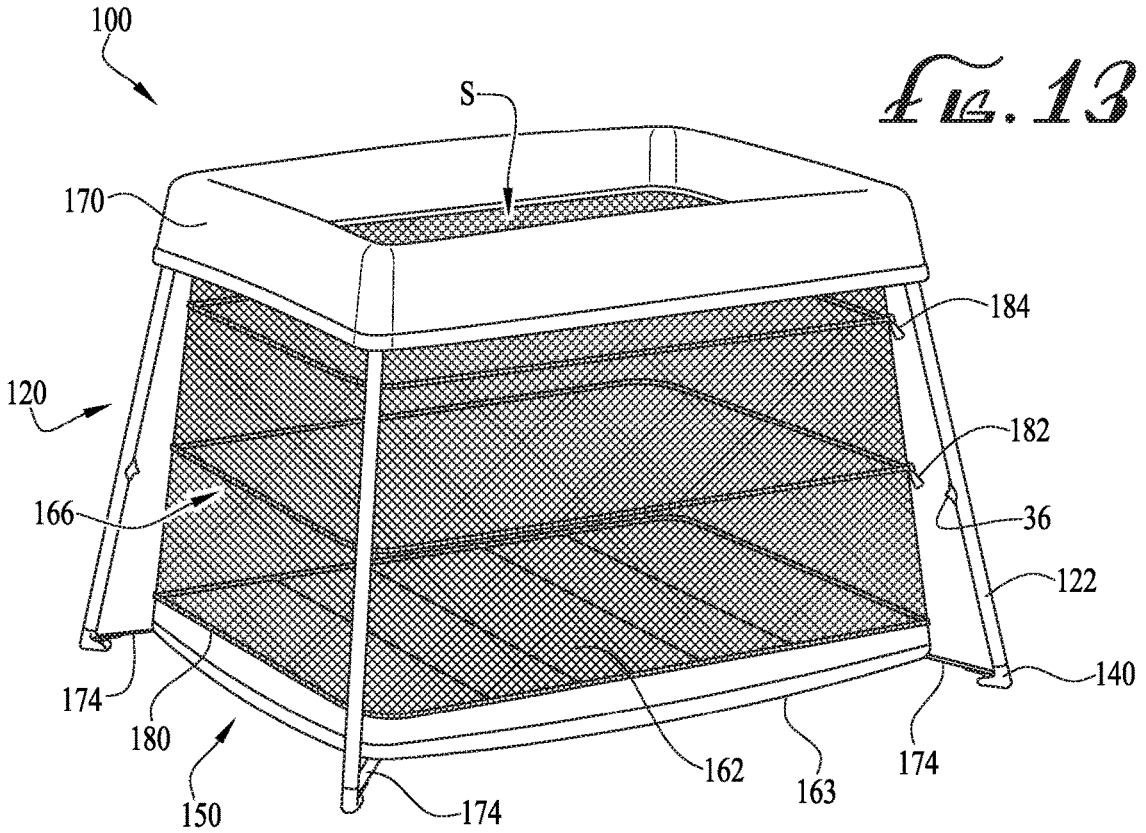
FIG. 13 is a perspective view of a play yard having a depth-adjustable fabric enclosure according to another example embodiment, wherein a floor portion of the depth-adjustable fabric is positioned at a first floor position.
Figure 14:
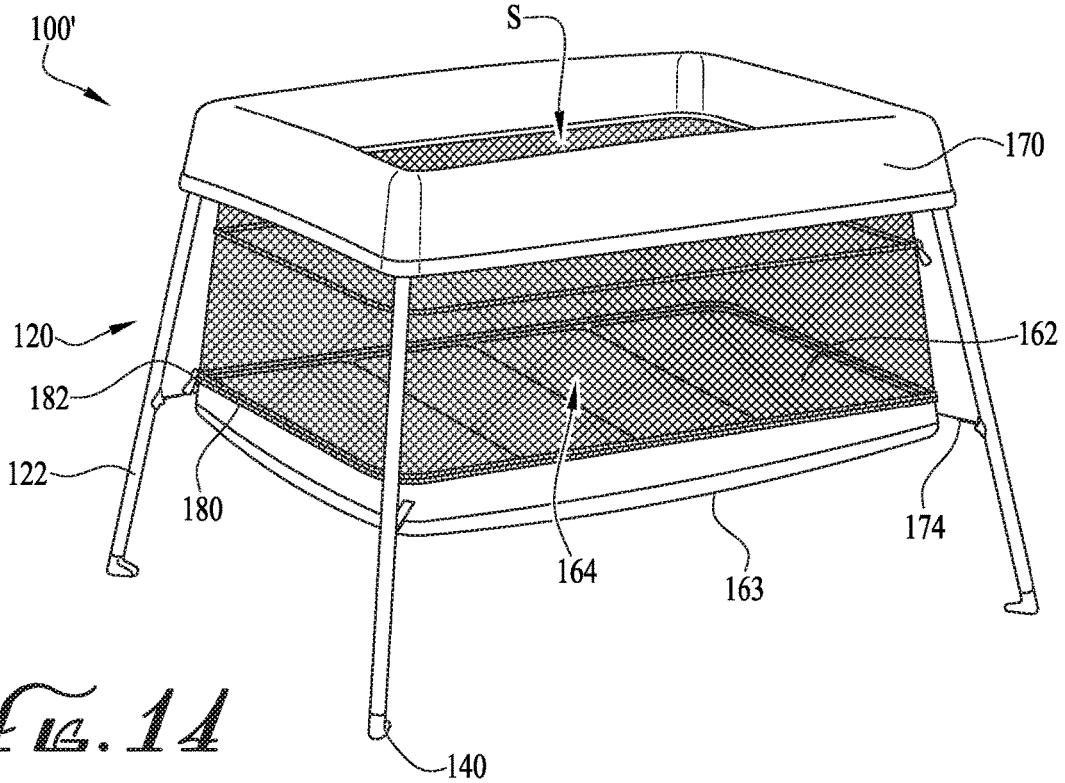
FIG. 14 is a perspective view of the play yard of FIG. 13, showing the depth-adjustable fabric enclosure configured as a bassinet, according to another example embodiment, with the floor of the depth-adjustable fabric enclosure is positioned at a second floor position.

FIGS. 13-14 show a child containment device according to another example embodiment. As depicted, the child containment device comprises a structural support frame 120 and an enclosure or liner 150. As similarly described above, the liner 150 is removably mounted to the structural support frame 20 and convertible between two or more floor positions, for example, such that the child containment device is convertible between a play yard configuration 100, a bassinet configuration 100', and a sleeper configuration (not shown).

As similarly described above, the liner 150 generally includes side panels 164, end panels 166, and a floor panel 163. In example forms, an upper portion of the side and end panels 164, 166 of the liner 150 can comprise a flap portion 170, which is positioned at the open end of the rectangular side wall panels 164 and the rectangular end wall panels 166. In example embodiments, the flap portion 170 is at least partially folded around a portion of the support frame 120. In example forms, instead of generally folding the flap portion 170 on itself as described above, a pair of zippered teeth 180, 182 and 184 are provided and generally extend horizontally around the periphery of the liner 50 (e.g., generally extending along each panel 164, 166 at the same height), to provide for interengagement therebetween, for example, to adjust the height of the mattress 162 (or the floor panel 163) relative to the support or ground surface. Preferably, the floor panel 163 is generally contacting or engaging the ground surface when the child containment device is in the play yard configuration 100.

As shown in FIG. 14, the child containment device is in the bassinet configuration 100' and the horizontal extension of zippered teeth 180 are generally interengaged with the zippered teeth 182, for example, which are generally positioned at a height that is greater than the bottom of the panels 164, 166, but is generally shorter than a top portion of the panels 164, 166. In example forms, the zippered teeth 184 are similarly interengageable with the zippered teeth 180, for example to convert the child containment device to a sleeper configuration. Optionally, one or more fastening members 174 and be provided for securing at least portions of the liner 150 to the support frame 120. In some example forms, the liner 150 is formed from a substantially stretchable and resilient fabric as described above. In alternate embodiments, the liner 150 is formed from a plurality of substantially inelastic, non-stretchable fabrics. Optionally, at least a portion of the liner can be formed from a substantially stretchable and resilient fabric material, and wherein one or more other portions of the liner 150 can be formed from substantially inelastic, non-stretchable materials, or for example, semi-stretchable materials or fabrics. In some example forms, it is desirable to provide shape to one or more portions of the internal containment volume S between the different configurations, and thus, some portions of the liner 150 can be provided with the substantially stretchable fabric or other stretchable materials to comprise a desirable deformation (or retraction due to being stretchable) of the liner 50 in either of the bassinet 100' or sleeper configuration.

Optionally, according to some example embodiments, the zippered teeth 180, 182 and 184 can be in the form of other inter-engagement members or couplings, for example, one or more clips, hook and loop (e.g., VELCRO) material, buckles, snaps, ties, hooks, or other releasably engageable members.

Figure 17:
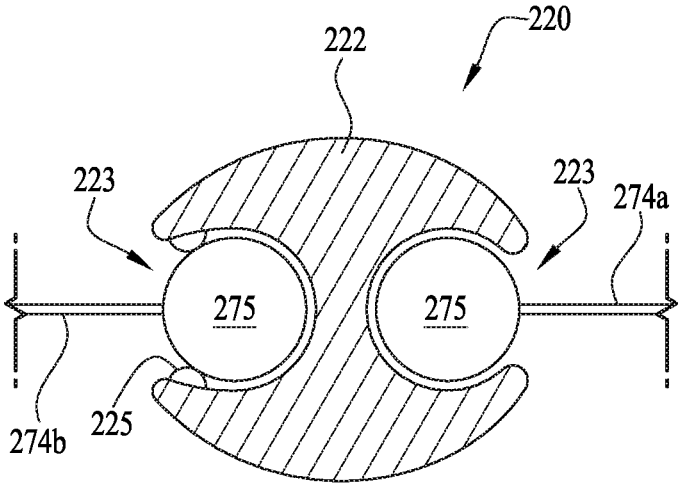
FIG. 17 shows a cross-sectional view of a portion of the support frame of FIG. 16 taken along line 17-17.
Figure 15:
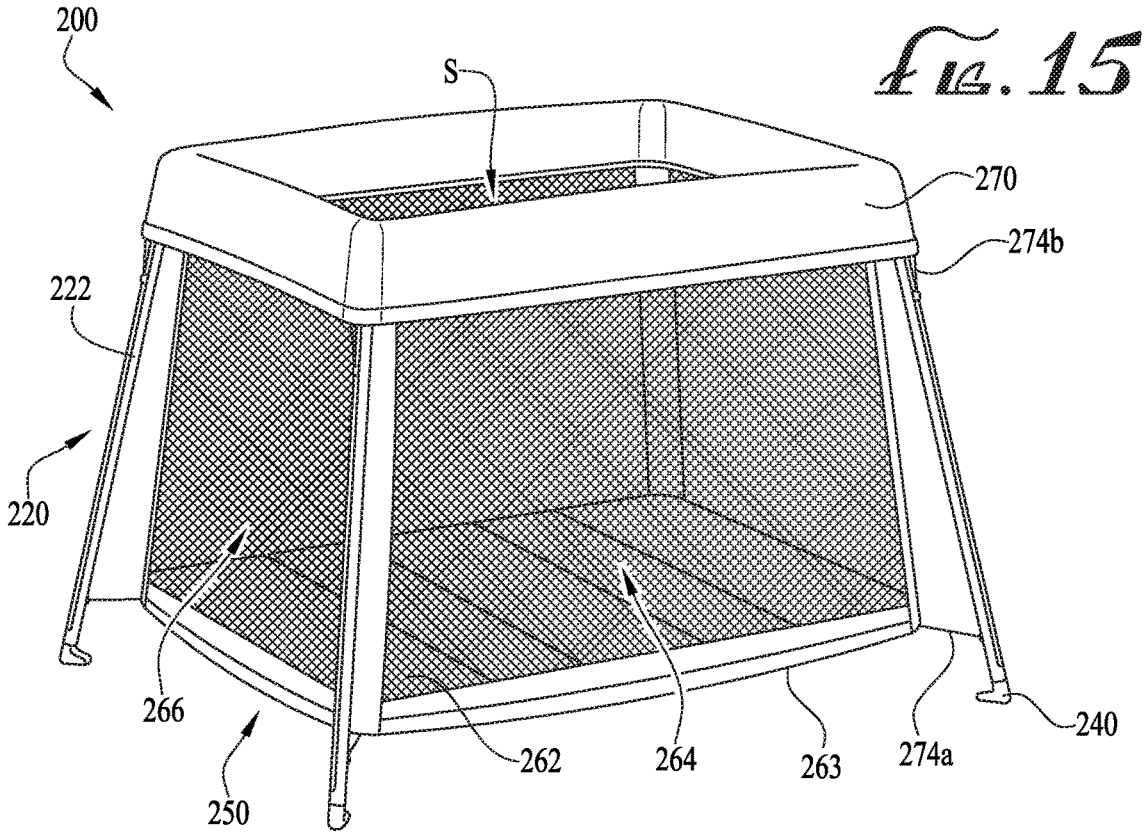
FIG. 15 is a perspective view of a play yard having a depth-adjustable fabric enclosure according to another example embodiment, wherein a floor portion of the depth-adjustable fabric is positioned at a first floor position.
Figure 16:
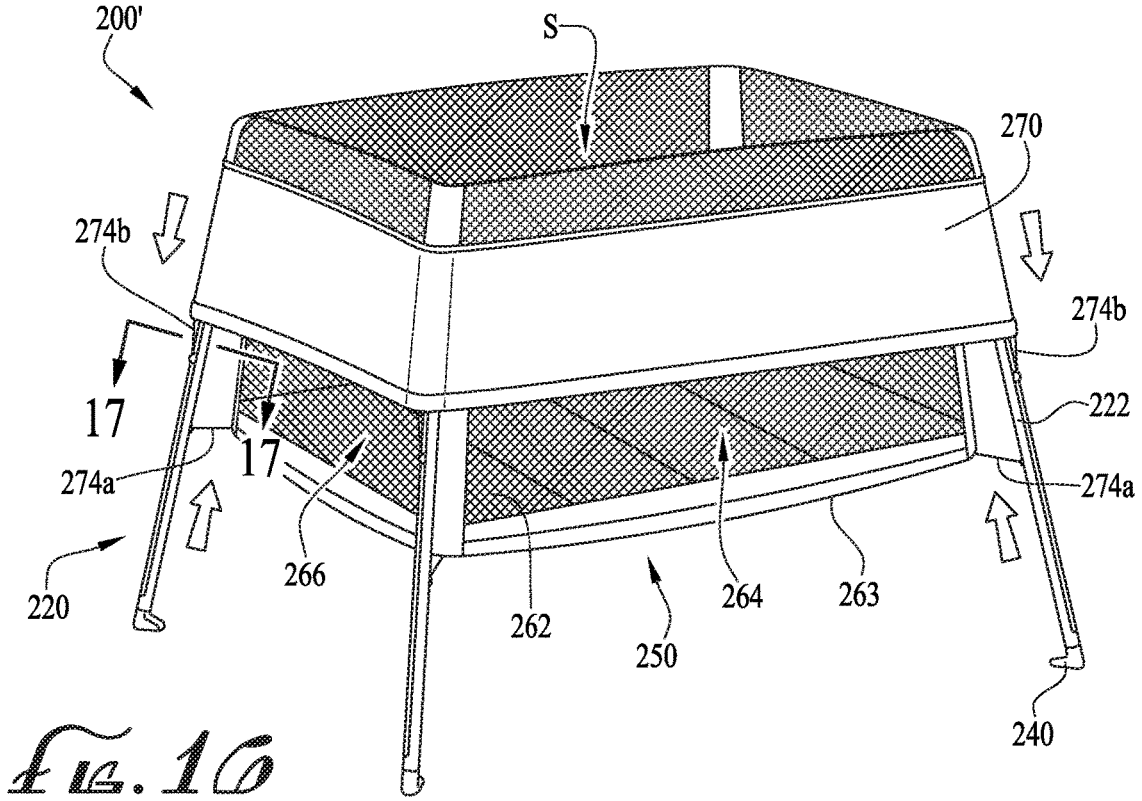
FIG. 16 is a perspective view of the play yard of FIG. 15, showing the depth-adjustable fabric enclosure configured as a bassinet, according to another example embodiment, with the floor of the depth-adjustable fabric enclosure positioned at a second floor position.

FIGS. 15-17 show a child containment device according to another example embodiment. As depicted, the child containment device can be convertible between a play yard configuration 200, a bassinet configuration 200', and a sleeper configuration (not shown). Preferably, the child containment device is configured such that the height of the mattress 162 can be secured at a plurality of different heights. As depicted, each of the corner posts 222 define two generally spaced-apart channels 223 extending along the length thereof. In example embodiments, a shuttle or slide-rod 275 is generally movably mounted within an outer channel of the channels 223 and connected to the flap portion 270 of the liner 250 by a strap, tether or other connector 174*b*. Similarly, a shuttle or slide-rod 275 is movably mounted within the inner channel of the channels 223 and connected to the floor panel 263 (or a portion of the panels 264, 266). Thus, with the liner 250 engaged with the shuttles 275, and the shuttles 275 engaged with portions of the liner 250, the height of the mattress 262 (or floor panel 263 supporting the mattress 262) can be adjustable between a plurality of different heights. In the play yard configuration 200, the floor panel 263 is at a first floor height and generally in contact with the ground surface. In the bassinet configuration 200', the mattress 262 is generally positioned at a second floor position that is at least partially offset upwardly from the first floor position. And, in the sleeper configuration, the mattress 262 is at a third floor position that is at least partially offset upwardly from the second floor position. Optionally, the height of the mattress 262 can generally be configured as desired, for example, at a height that is generally between the ground surface and an uppermost portion of the corner posts 222. In some example forms, as depicted in FIG. 17, one or more interengagement members 225 can be provided within one or more portions of the channels 223, or can be formed along at least a portion of the extension of the channels 223 such that the shuttles 275 can be frictionally engaged with the channel 223, and thus allow for substantial securement of the mattress 262 at a particular position. Thus, in some example forms, at least portions of the length of the channels 223 can comprise interengagement members 225, which can extend a desirable length, to provide for generally substantially securing the liner 250 (and floor panel 263) at a particular height. In alternative example embodiments, the liner 250 can be secured and positioned between the configurations by use of other fasteners, for example, with clips, hooks, snaps, etc. In some example forms, a plurality of interengagement members or fasteners are provided along the length of both the outer and inner portions (or sides) of the corner posts 222, and wherein portions of the liner 250 comprise interengagement features or fasteners for providing removable coupling engagement with the fasteners of the corner posts 222, for example such that the floor panel 263 can be positioned at a plurality of floor heights.

In example embodiments, as described above, the liner 250 can be substantially stretchable and elastic, substantially inelastic and non-stretchable, or can be a combination of both comprising stretchable, elastic portions and inelastic, non-stretchable portions. For example, according to some example embodiments, when the corner posts 222 extend outwardly (e.g., forming a trapezoidal/pyramid frame), the liner 250 is configured to be at least partially elastic and stretchable, for example, to conform to the shape of the frame 220 in the several configurations. Alternatively, in some example embodiments, when the corner posts 222 are configured for extending substantially vertical (e.g., up and down), the liner 250 can be inelastic and non-stretchable.

Figure 18:
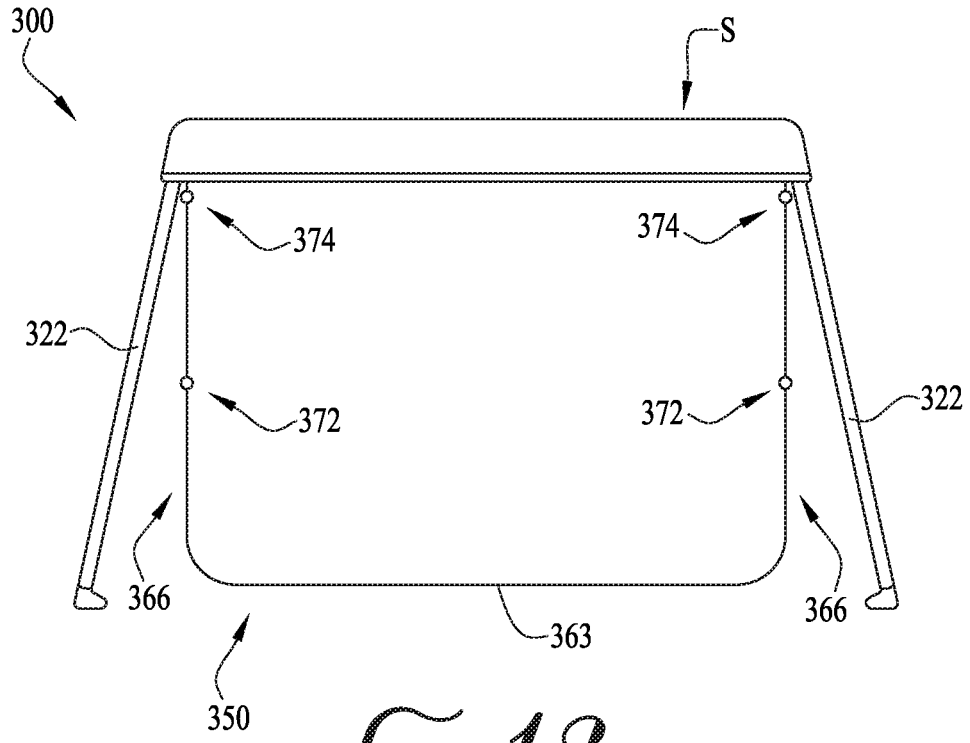
FIG. 18 shows a side plan view of a play yard having a depth-adjustable fabric enclosure according to another example embodiment, wherein a floor portion of the depth-adjustable fabric is positioned at a first floor position.
Figure 19:
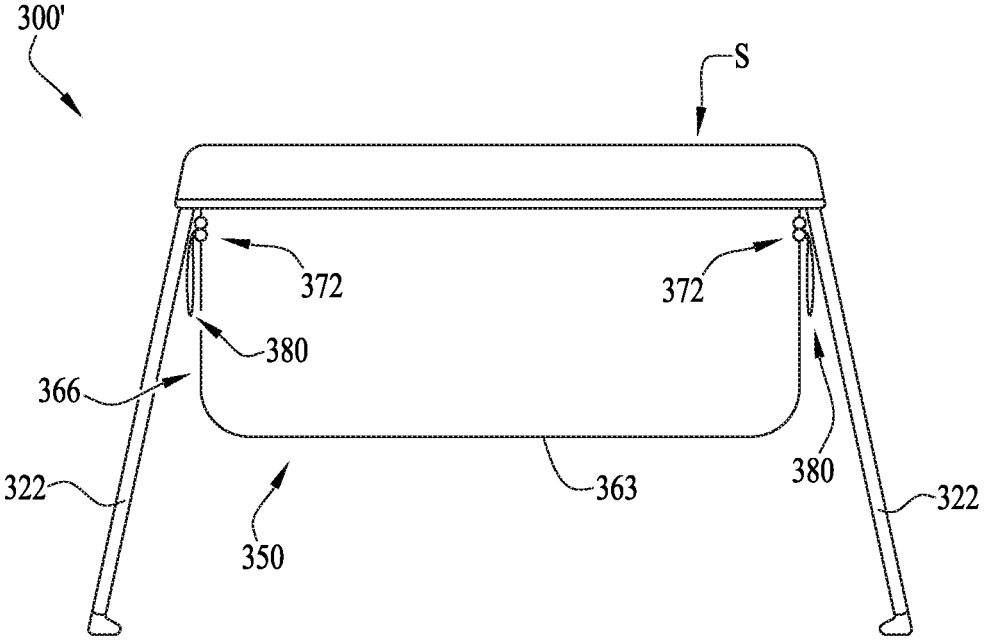
FIG. 19 shows a side plan view of the play yard of FIG. 18, showing the depth-adjustable fabric enclosure configured as a bassinet, according to another example embodiment, with the floor of the depth-adjustable fabric enclosure positioned at a second floor position.

FIGS. 18-19 show a show a child containment device according to another example embodiment. As depicted, the child containment device can be convertible between a play yard configuration 300, a bassinet configuration 300', and a sleeper configuration (not shown). Preferably, the child containment device is configured such that the height of the mattress 362 (or floor panel 363) can be secured at a plurality of different heights. As depicted, the sidewall enclosure (or panel(s) thereof—depicted as end wall panels 366) comprises a plurality of interengagement members or fasteners 372, 374 for providing removable coupling engagement therebetween, for example, to adjust the height of the floor panel 363 relative to the support surface. As depicted in FIG. 18, the end wall panels 366 of the liner 350 comprise first fasteners 372 generally mounted to an intermediate or middle portion of the panel 366 (e.g., between the floor panel 363 and upper portion), and comprise second fasteners 347 generally mounted to an upper portion of the end wall panels 366. Thus, as shown in FIG. 19, the first and second fasteners 372, 374 are coupled together to provide for adjustment to the height of the floor panel 363, for example, to convert the child containment device from a play yard configuration 300 to a bassinet configuration 300'. In example embodiments, convertibility between the configurations is provided by an accordion-like fold 380 of the liner (the excess fabric is generally resting and hanging on an outer or exterior portion of the liner 350), for example, whereby the first and second fasteners are coupled together to provide adjustment to the height of the floor panel. Preferably, additional fasteners can be provided such that the floor panel 363 can be adjustable between a plurality of heights. Optionally, one or more of the fasteners can be mounted to portions of the frame or corner posts 322, and the accordion-like flap 380 can be configured for hanging interiorly, for example, within the area defining the interior containment volume S. In example embodiments, the liner 350 is substantially inelastic and non-stretchable. Optionally, the liner 350 can be substantially elastic and stretchable, or can be at least partially stretchable as desired.

Figure 20:
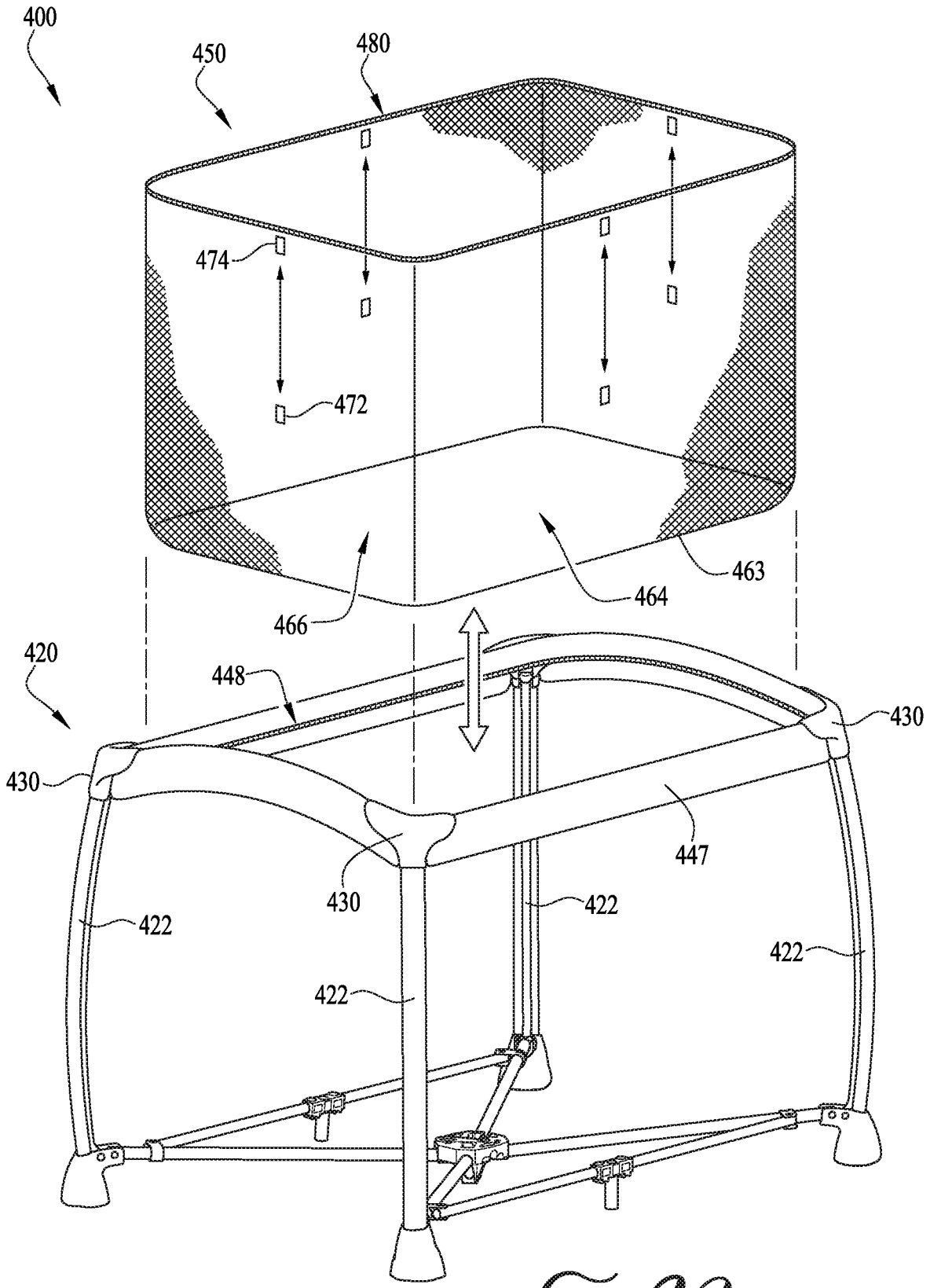
FIG. 20 shows a perspective assembly view of a play yard according to another example embodiment, showing a sleeve connected to an upper portion of a structural support frame and having fasteners for coupling engagement with a depth-adjustable fabric enclosure.

FIG. 20 shows a child containment device according to another example embodiment. As depicted, the child containment device can be convertible between a play yard configuration 400, a bassinet configuration (not shown), and a sleeper configuration (not shown). Preferably, the child containment device is configured such that the height of the mattress 362 (or floor panel 363) can be secured at a plurality of different heights. As depicted, the sidewall enclosure (or panel(s) thereof—depicted as side and end wall panels 464, 466) comprises a plurality of interengagement members or fasteners 472, 474 for providing removable coupling engagement therebetween, for example, to adjust the height of the floor panel 363 relative to the support surface (as described in FIGS. 18-19). In example embodiments, the structural support frame 420 comprises a sleeve 447 for coupling to the upper side and end cross-members. Preferably, the sleeve 447 comprises a fastener 448 for providing coupling engagement with a fastener 480 of the liner 450, for example, to connect the liner 450 to the structural support frame 420. In example embodiments, the fasteners 448, 480 are generally in the form of zippered teeth, which are interengageable with each other and generally extend around the entire perimeter of the respective sleeve 447 and sidewall enclosure of the liner 450. In example embodiments, the sleeve 447 can be formed to extend around the entire upper perimeter of the support frame, or for example, can comprise individual sleeves for connecting to each of the upper cross-members. The sleeve 447 can be permanently mounted to the cross-members, or the sleeve can be removably attached thereto to provide for removal therefrom. Similarly, the fasteners 447, 480 can be configured for permanent or removable engagement therebetween. In alternate embodiments, the fasteners for securing the liner 450 to the frame (e.g., fasteners 447, 480) and the fasteners of the liner 450 for providing adjustment to the height of the floor panel 463 (e.g., 472, 474) can be in other forms, for example, other mating fasteners including clips, hooks, snaps, or other inter-engagement members as desired. In example embodiments, the liner 450 is substantially inelastic and non-stretchable. Optionally, the liner 450 can be substantially elastic and stretchable, or can be at least partially stretchable as desired.

FIGS. 21-24 show a child-containment device 500 according to another example embodiment. The child-containment device 500 can have the same or substantially the same basic design and construction as any of the previously described embodiments. As such, the child-containment device 500 includes a structural support frame 520 and an elevator height adjusting (aka depth-adjustable) enclosure 550 supported by the frame 520.

Figure 23:
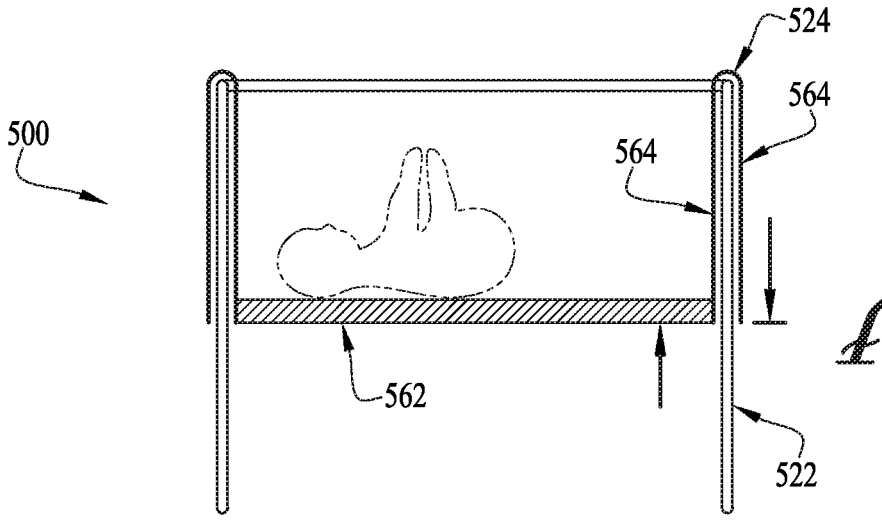
FIG. 23 is a cross-sectional view of the child enclosure of FIG. 21 configured as a sleeper with the floor in a second/intermediate floor position.
Figure 24:
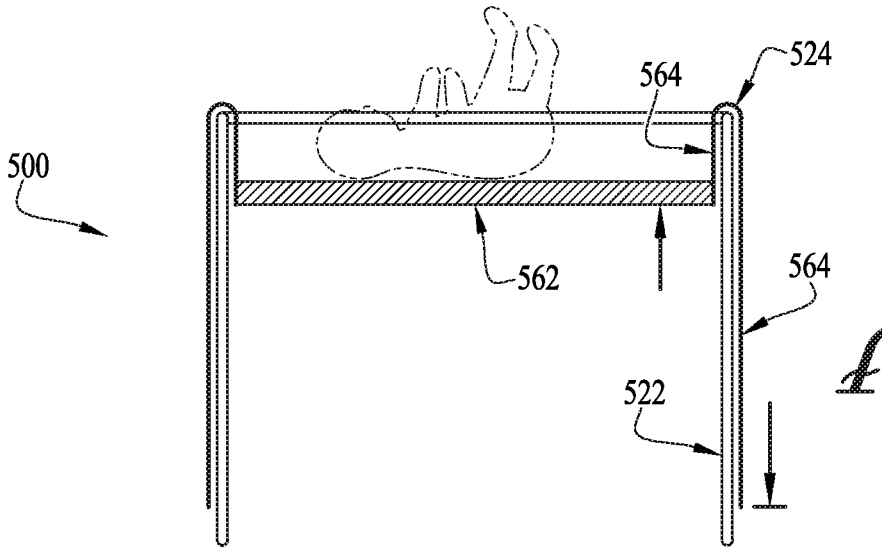
FIG. 24 is a cross-sectional view of the child enclosure of FIG. 21 configured as a diaper-changing station with the floor in a third/raised floor position.

The enclosure 550 includes a support surface (e.g., a floor) 562 and flexible walls 564 that that are connected to the support surface 562 to together define an internal containment volume. The flexible walls 564 are vertically slidable relative to the support frame 520 to reposition/adjust the support surface 562 to a plurality of different height/depth positions. In the depicted embodiment, for example, the child-containment device 500 can be adjustable and convertible (see FIG. 21) between a play yard configuration with the support surface 562 in a first/lower position (FIG. 22), a sleeper configuration with the support surface 562 in a second/intermediate position (FIG. 23), and a diaper-changing station configuration with the support surface 562 in a third/upper position (FIG. 24). The child-containment device 500 can include inter-engaging elements (e.g., seating, indexing, or catch members) configured so that the different positions of the support surface 562 are discrete and pre-defined, or the child containment device 500 can be free of any such inter-engaging elements so that the support surface 562 can be positioned anywhere within the range between the lower and upper positions as selected by the user.

The structural support frame 520 includes upper peripheral frame members 524 and upright frame members 522 supporting the upper peripheral frame members 524. The upper peripheral frame members 524 define the periphery of the enclosure 550, for example, the depicted embodiment includes four upper frame members 524 arranged in a rectangular shape. The upright frame members 522 can be substantially vertical and corner-positioned, as depicted, or they can have another configuration such as X-members. In some embodiments such as that depicted, lower frame members 523 extend between the upright frame members 522. These frame members 522, 523, and 524 can be of a conventional type for example plastic or metal tubing.

The support surface 562 of the height/depth adjusting enclosure 550 can include a mattress (including a bed pad, matt, or cushion), as depicted, with the mattress sufficiently firm and rigid to by itself support the child without sagging, or with a substantially rigid platform provided for supporting the mattress and child. In some embodiments, the support surface includes a semi-rigid floor, a flexible webbing or netting, a substantially rigid platform without a mattress, or another element that can support an infant and/or other object(s). And the flexible walls 564 can be provided by a fabric (as depicted), a mesh, or other flexible sheet-like material. In typical embodiments, the flexible walls 564 are substantially inelastic and non-stretchable. In other embodiments, the flexible walls are substantially stretchable and elastic, or include a combination of stretchable, elastic portions and inelastic, non-stretchable portions.

The flexible walls 564 have first end portions 565 that are connected to the support surface 562 at its peripheral edges, for example by conventional stitching, fasteners, or the like. The flexible walls 564 have a vertical length (from their first end portions 565 to their opposite second end portions 567) that is greater than the height of the upper frame members 524 (relative to a floor, table, or other surface supporting the child-containment device 500). This extra length is used to route the flexible walls 564 over, and suspend them from, the upper frame members 524 in an overlapping, double-walled arrangement, with the first end portions 565 of the flexible walls 564 positioned laterally inward (toward the interior of the enclosure 550) relative to the second end portions 567 of the flexible walls 564, and with each of the flexible walls 564 forming an inner wall portion and an outer wall portion. Further, the flexible walls 564 are vertically slideable about the corresponding upper frame members 524, with the upper frame members 524 acting as pulleys that enable the flexible walls 564 to freely travel over/around them. In some embodiments, the upper frame members 524 include rollers (e.g., coaxially and rotationally mounted onto the frame member or between sections of frame members) that facilitate this smooth travel of the flexible walls 564 about the upper frame members 524 (e.g., the coaxial rollers can rotate relative to the upper frame members as the corresponding/contacted flexible wall 564 is moved between positions without direct sliding contact with the top frame members). In alternate embodiments, the upper frame members 524 rotate with respect to the upright frame members 522 to facilitate the smooth travel of the flexible walls 564.

Figure 21:
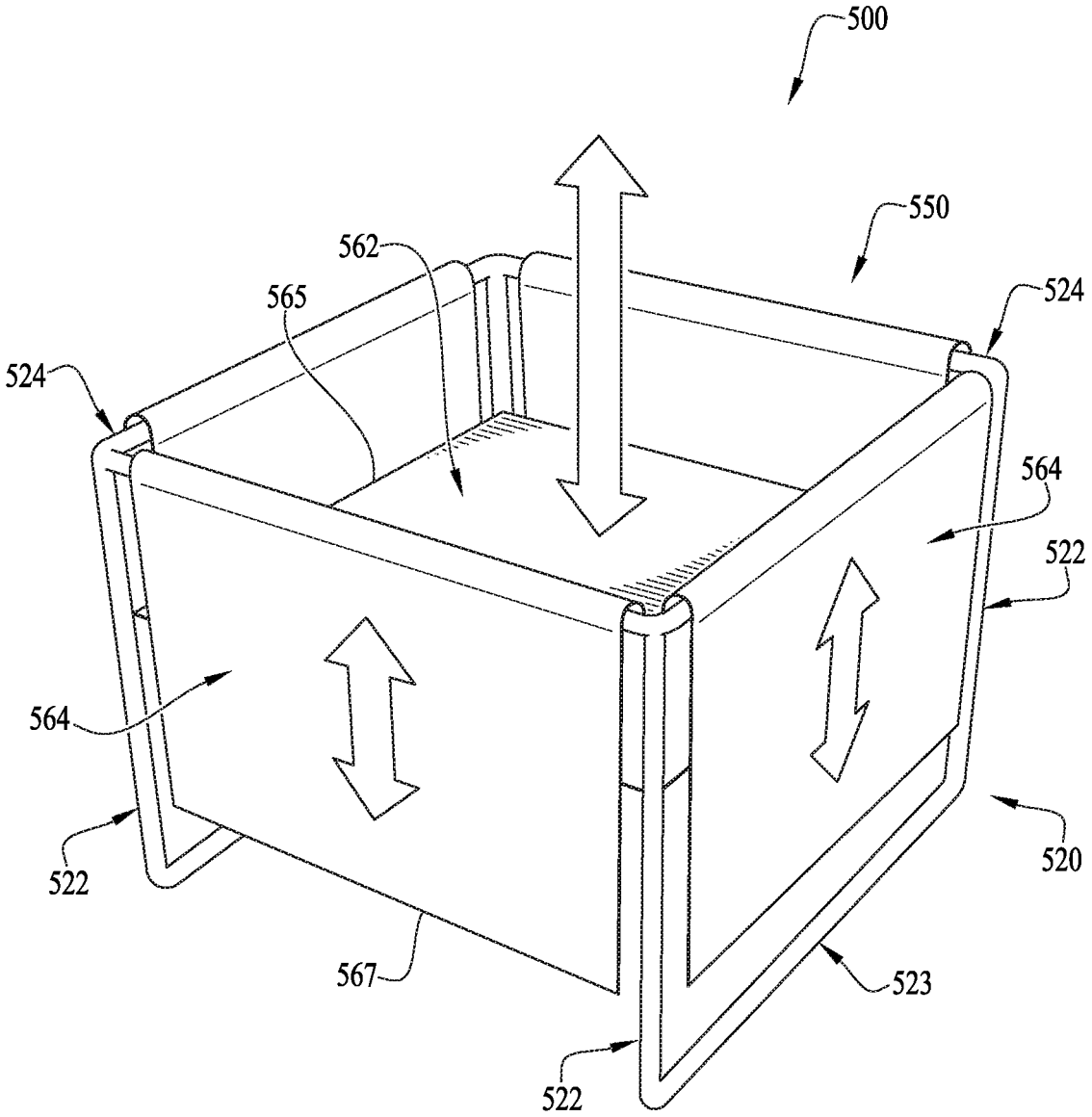
FIG. 21 is a perspective view of a child enclosure having a floor and an elevator height adjustment device according to another example embodiment.
Figure 22:
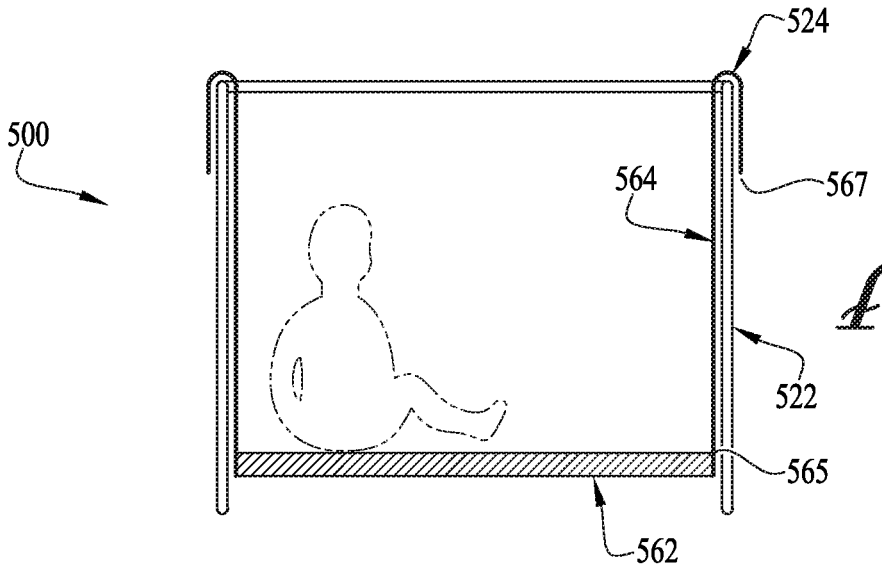
FIG. 22 is a cross-sectional view of the child enclosure of FIG. 21 configured as a play yard with the floor in a first/lowered floor position.

In this way, the support surface 562 can be raised or lowered (as depicted by the larger double-headed motion-indicating arrow in FIG. 21) by repositioning (with respect to each other) the inner and outer wall portions of the overlapping peripheral wall 564 (as depicted by the smaller double-headed motion-indicating arrows in FIG. 21). So pulling down on (or otherwise moving downward) the second end portion 567 causes the first end portion 565 and the connected support surface 562 to raise, and conversely raising the second end portion 567 (or allowing it to be raised under the weight of the child and/or other load acting downward on the support surface 562) causes the first end portion 565 and the connected support surface 562 to lower, as depicted in FIG. 21. In a typical commercial embodiment, for example, with the support surface 562 in a first/lower position defining a play yard configuration (FIG. 22), pulling down on the second end portion 567 of the flexible wall 564 (as indicated by the directional arrow in FIG. 23) causes the first end portion 565 and the connected support surface 562 to raise to a sleeper/bassinet configuration with the support surface 562 in a second/intermediate position (FIG. 23). And pulling down further on the second end portion 567 of the flexible wall 564 (as indicated by the directional arrow in FIG. 24) causes the first end portion 565 and the connected support surface 562 to raise to a diaper-changing station configuration with the support surface 562 in a third/upper position (FIG. 24). The child-containment device 500 can thereby be reconfigured to the various support-surface positions as desired by applying a downward force to the outer wall portion to raise the support surface or by releasing the outer wall portion (allowing it to be raised under the weight of the child and/or other load acting downward on the support surface 562) to lower the support surface.

It will be understood that, as used herein, the inner and outer portions of the overlapping walls 564 are defined by the current configuration, with the first end 565 always on the inside of the internal containment volume of the enclosure 550, but with other locations dependent on the configuration, because each configuration has a different length/portion of the wall on either side of the top frame member. For example, a longitudinal midpoint of one of the overlapping flexible walls 564 is on the inner wall portion in the configuration of FIG. 22, but it is on the outer wall portion in the configuration of FIG. 24. And with the support surface 562 in the third position above the first position, the inner wall portion above the support surface has a smaller height than in the first position.

In addition, the elevator height adjusting (aka depth-adjustable) enclosure 550 typically includes a locking mechanism to secure the support surface 562 in its selected height position. In typical embodiments, the locking mechanism includes inter-engaging fastening elements that mechanically engage each other to secure the flexible walls 564 in place and prevent them from moving between their various configuration positions and that can be released from such mechanically secured engagement to allow them to move between their various configuration positions. In example embodiments, the inter-engaging fastening elements may be on the frame 520, on another/overlapping portion of the wall 564, or on both the frame and another/overlapping portion of the wall.

Figure 25A:
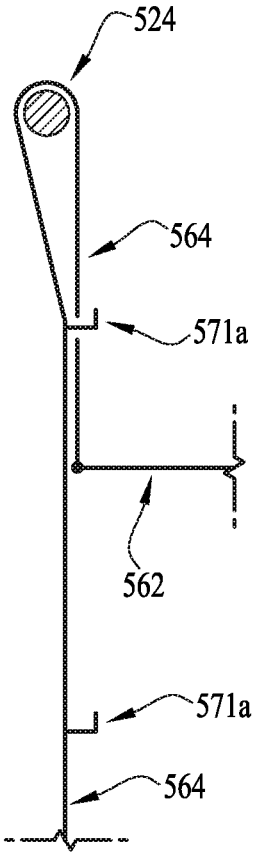
FIG. 25A is a detail side view of a portion of the child enclosure of FIG. 21 showing a locking mechanism for releasably securing the floor in the various positions.
Figure 25B:
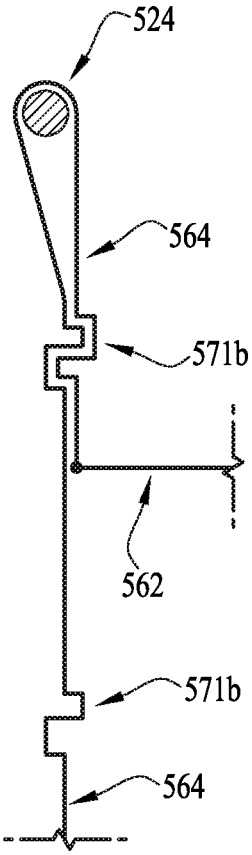
FIG. 25B is a detail side view of a portion of the child enclosure of FIG. 21 showing another locking mechanism for releasably securing the floor in the various positions.

For example, the locking mechanism can be provided by a ratchet mechanism that includes inter-engaging fasteners in the form of a gear (round or linear) and a pawl that displaces from engagement with the gear to permit the support surface 562 to be freely raised by applying a pulling force on the second end portion 567 (or another portion) of the flexible wall 564, that securely engages the gear to lock the support surface 562 in place when the force is removed from the second end portion 567 of the flexible wall 564 (i.e., when it's released by the user), and that can again be displaced to release/free the flexible wall 564 to slide again so the support surface 564 can be returned to a lower position. Alternatively, the locking mechanism can include inter-engaging fasteners in the form of a hook-and-receiver arrangement of hooks (e.g., J-shaped or tabs) that engage any of a series of receivers (e.g., slots or holes), with the hooks or the receivers on the wall 564 and the other of the hooks or the receivers on the frame 520 or another/overlapping portion of the wall 564 (see for example the inter-engaging fasteners 571*a* of the locking mechanism of FIG. 25A). In embodiments with the frame members 520 oriented horizontal at the top of the child-containment device 500 and vertical at the corners, the frame members 520 together define side openings, and the inner and outer portions of the overlapping peripheral walls 564 can be adjacent and contact each other with the locking mechanism including a plurality of inter-engaging fasteners in the form of elements on the inner and outer wall portions with respective pairs of the fasteners in alignment and releasably connectable in each of the respective configurations (see for example the inter-engaging fasteners 571*b* of the locking mechanism of FIG. 25B). Other locking mechanisms known in the art can be included for example with inter-engaging fasteners in the form of snap-fit couplings, a spring-biased button and series of receiver holes for the button in its extended configuration, a zipper, hook-and-loop material, and other conventional structures for releasably securing two parts together. Also, a failsafe or backup locking mechanism can be included for redundancy for the safety of the contained/supported child in the event of a failure of the primary locking mechanism.

In other embodiments, a synchronization system can be included so that the peripheral walls 564 on different sides of the child-containment device 600 reposition together (i.e., moving/repositioning the wall on one side moves/repositions the walls on the other three sides) so the support surface 562 remains level in the various different positions and as its moved between the positions. In typical embodiments, the synchronization system includes inter-engaging synching elements that mechanically engage or link the adjacent flexible walls 564 of adjacent sides of the enclosure 550 so that they move together, and so moving one of the walls in turn causes the other three walls to move through the same motion such that only one wall needs to be moved to reconfigure the enclosure 550.

Figure 26:
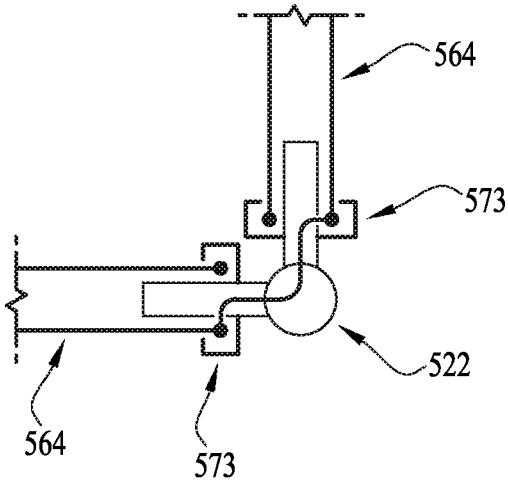
FIG. 26 is a detail top view of a portion of the child enclosure of FIG. 21 showing a synchronization system for the flexible walls of adjacent sides of the enclosure.
Figure 28:
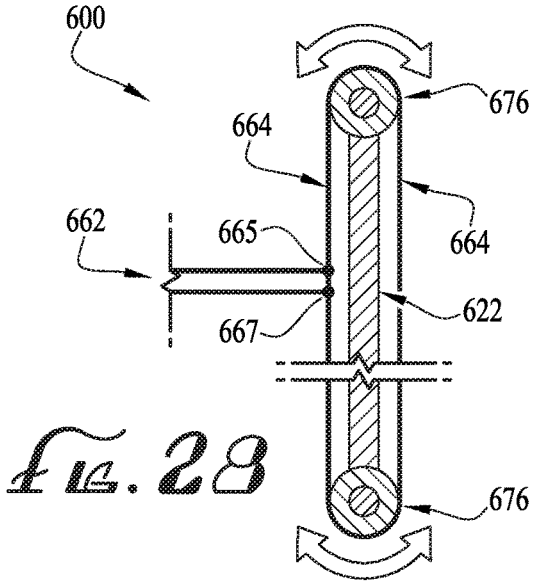
FIG. 28 is a cross-sectional view of a portion of the child enclosure of FIG. 25, showing details of the elevator height adjustment device.
Figure 27:
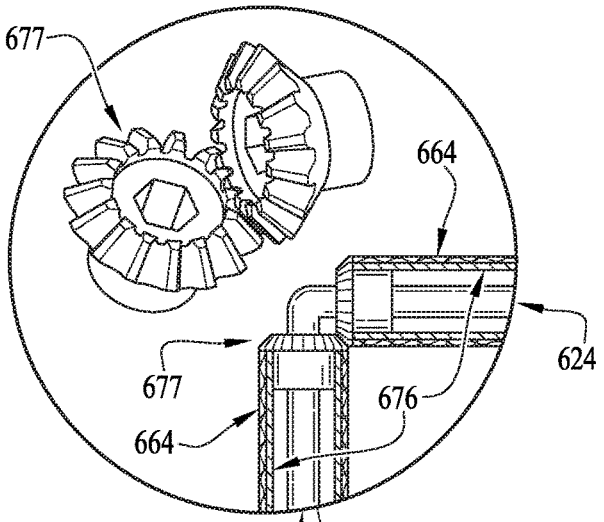
FIG. 27 is a perspective view of a child enclosure having a floor and an elevator height adjustment device according to another example embodiment, with an enlarged detail showing a top view of a corner portion of the child enclosure and also showing a perspective view of intermeshed gears of the elevator height adjustment device.
Figure 27:
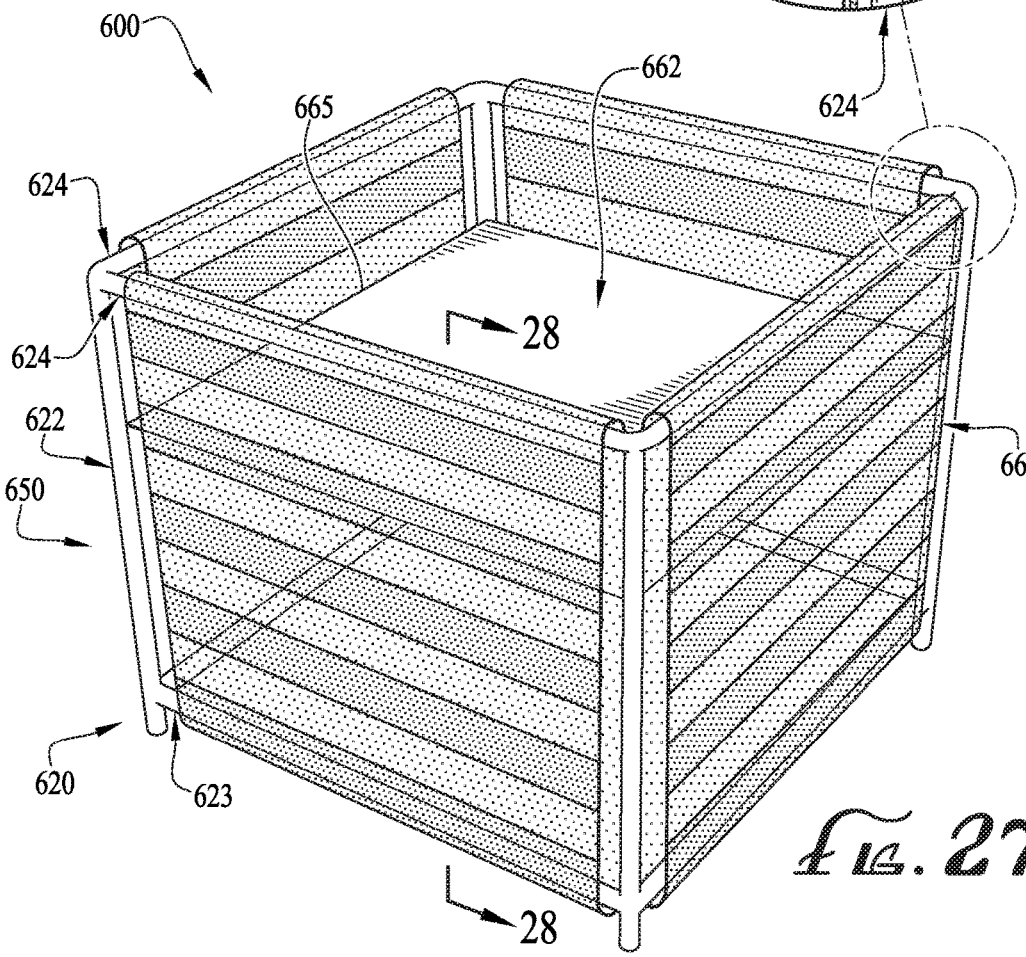
Figure 29A:
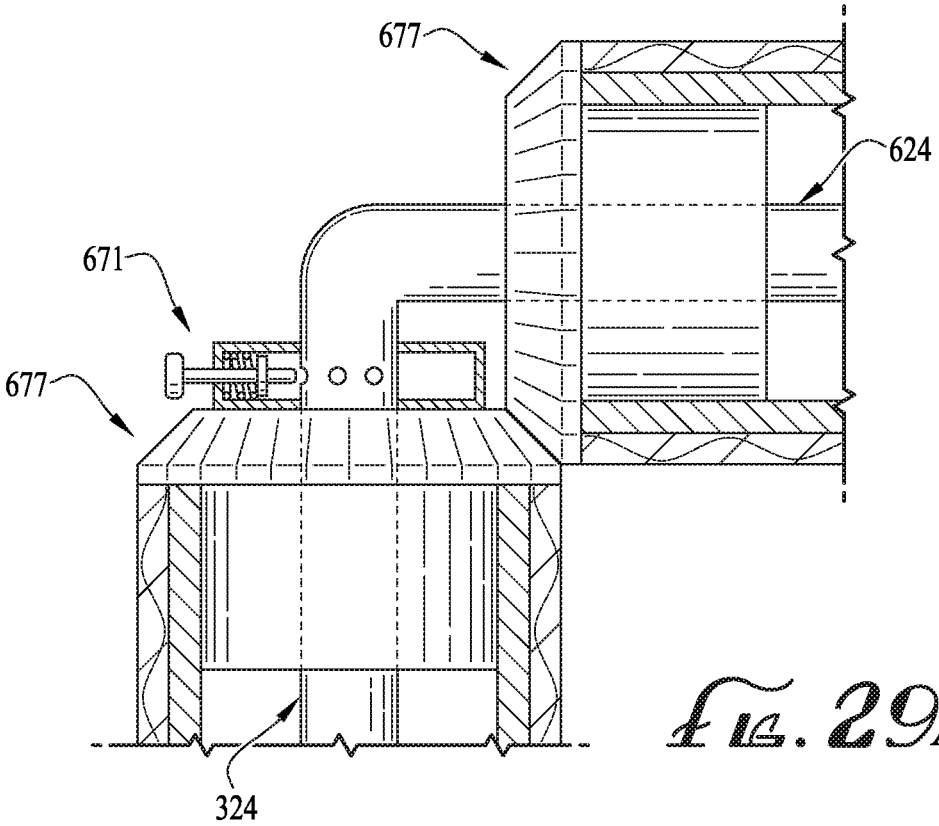
FIG. 29A is a detail side view of a portion of the child enclosure of FIG. 27 showing a locking mechanism for releasably securing the floor in the various positions with the locking mechanism in an unlocked/released position.
Figure 29B:
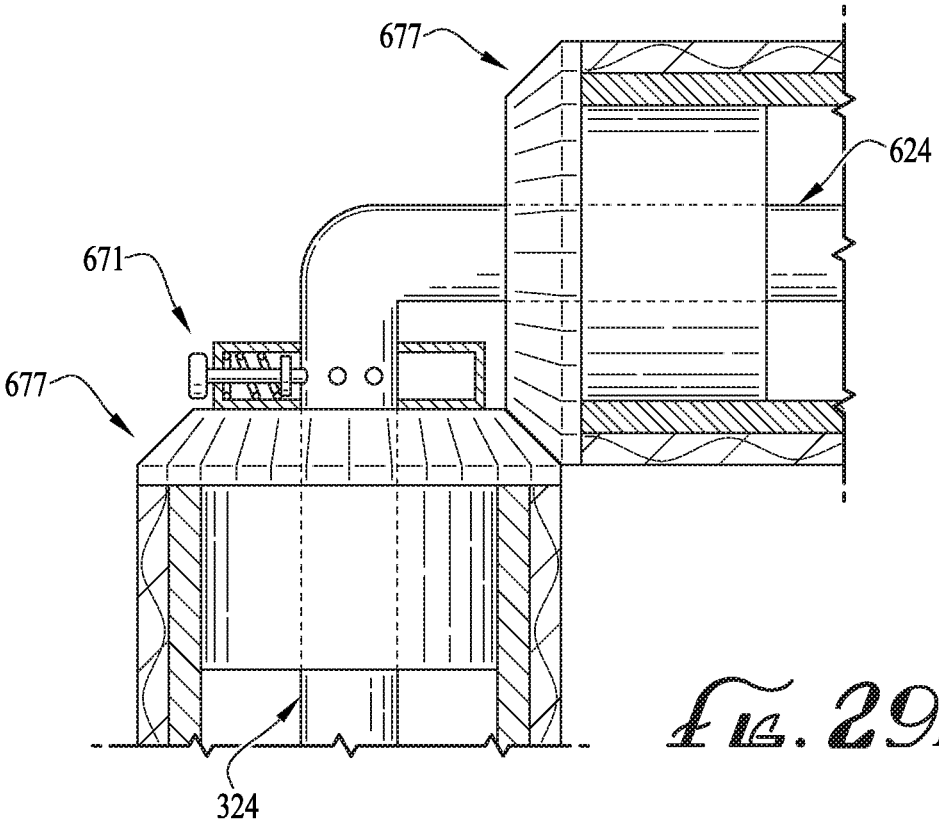
FIG. 29B shows the child enclosure portion of FIG. 29A with the locking mechanism in a locked/secured position.
Figure 30:
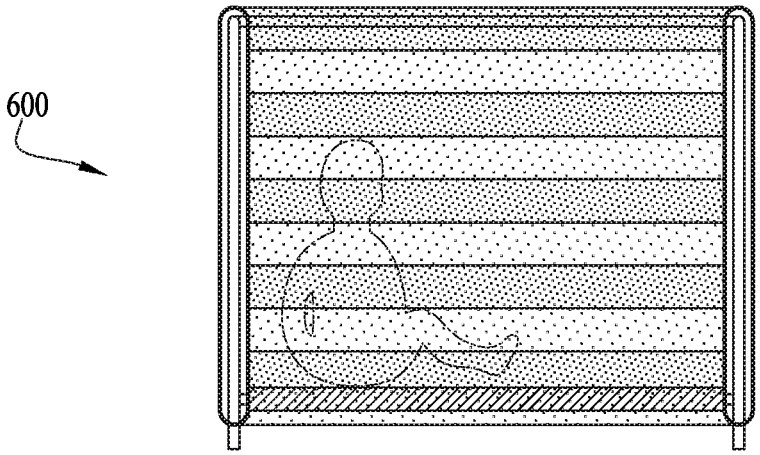
FIG. 30 is a cross-sectional view of the child enclosure of FIG. 28 configured as a play yard with the floor in a first/lowered floor position.
Figure 31:
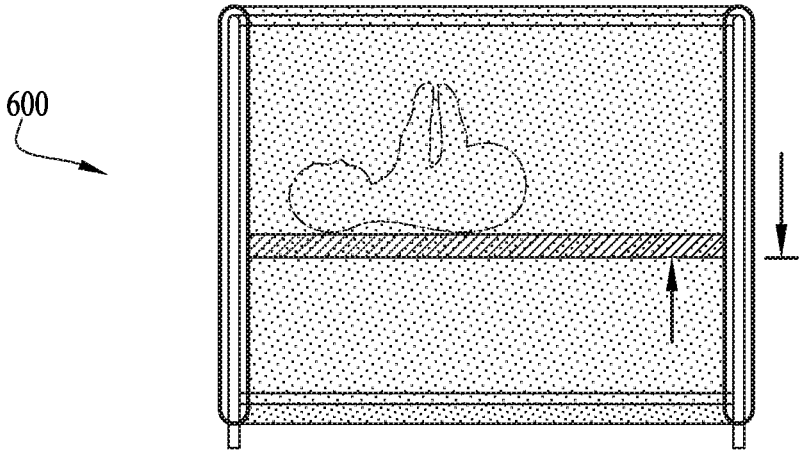
FIG. 31 is a cross-sectional view of the child enclosure of FIG. 28 configured as a sleeper with the floor in a second/intermediate floor position.

For example, the inter-engaging synching elements can be in the form of meshing miter gears on adjacent upper frame members 524 to provide the synchronized movement and control of the peripheral walls 564 on different sides of the child-containment device 500 (see also the embodiment of FIG. 27). In embodiments in which the frame 520 includes rollers that rotate relative to the upper frame members 524 as the corresponding flexible wall 564 is moved between positions, the synchronization system can be incorporated into the coaxial roller system for example by pinion gear of the type described above. In some embodiments, the corner frame members can be L-shaped (e.g., L-brackets) with each of the two perpendicular (to each other) frame sections extending into the space between the overlapping inner and outer wall portions 564 at each adjacent side of the enclosure 550 and including a track to which the inner and outer wall portions are slidably attached to enable their vertical movement (thereby forming a continuous peripheral-walled enclosure with no gap between adjacent walls through which a child could extend a hand and be injured), with incorporated synchronizing elements in the form of linkages (e.g., elastic sheets or strips) extending between the adjacent walls 564 and routed through or across the L-brackets (see for example the interconnecting linkages 573 of the synchronization system of FIG. 26). Furthermore, the locking mechanism can be incorporated into the synchronization system and/or the coaxial roller system.

FIGS. 27-32 show a child-containment device 600 according to another example embodiment. The child-containment device 600 can have the same or substantially the same basic design and construction as any of the previously described embodiments. As such, the child-containment device 600 includes a structural support frame 620 and an elevator height adjusting (aka depth-adjustable) enclosure 650 supported by the frame 620.

In this embodiment, the structural support frame 620 includes lower horizontal frame members 623 on all sides and they are parallel to the horizontal upper frame members 624 with upright frame members 622 extending between the upper and lower frame members, and the flexible sidewall 664 is routed around the lower frame members 623 and the upper frame members 624 in a looped arrangement with the first and second end portions 665 and 667 of the flexible walls 664 connected to the support surface 662. So the flexible walls 664 are in an overlapping, double-walled arrangement along their entire height. This provides for a smooth operation and prevents bunching and wrinkling of the flexible sidewalls 664.

In addition, the lower and upper frame members 623 and 624 include rotational rollers 676 about which the flexible walls 664 are routed for smooth rolling travel of the flexible walls 664 around them, and the rollers 676 are operably connected together by a synchronization system for collective movement together (vertically moving one wall rotationally moves its roller which in turn rotationally moves the adjacent rollers which in turn vertically moves their walls in a coordinated manner). For example, the rollers 676 can have miter gears 677 at their ends so that the gears 677 of adjacent rollers 676 mesh for rotation together. This synchronized co-rotation provides for a smooth operation and helps keep the support surface 662 in a generally constant (e.g., horizontal) orientation.

In some embodiments, the flexible walls include control features for moving the support surface between its various positions. These can include knobs or finger-holes extending from or formed in the walls, or other structures enabling manual engagement by the hand of an adult caretaker for manual repositioning. Alternatively, these can include a motor that drives one of the miter gears, a power supply (e.g., batteries, power cord for connecting to house voltage, etc.) connected to the motor, and a control unit (e.g., for on/off and directional control) for controlling the motor.

Furthermore, the flexible walls 664 and their respective rollers 676 can be designed so that they move together with no or negligible slippage between them. For example, the rollers can have a textured surface for gripping the walls, a circumferential series of nubs that receive into a series (e.g., a vertical track or strip) of recesses in the walls, a pinion gear that meshes with a flexible rack gear along the walls, or other conventional structures (e.g., the seating, indexing, or catch members disclosed above) that prevent such slippage.

There can be four separate flexible walls 664 each moving over one of four horizontal upper frame members 624, as depicted, with corner gaps between adjacent individual flexible walls 664. To minimize or eliminate such gaps, the flexible walls 664 can each extend substantially the entire length of the horizontal upper frame members 624. And to complete the enclosure, corner wall panels (not depicted) can be provided to substantially close off any such gaps. In other embodiments, the enclosure can include corner L-brackets and/or vertical guide tracks (see for example FIG. 26) to close off any gaps and form a continuously extending, peripherally enclosed space.

Figure 32:
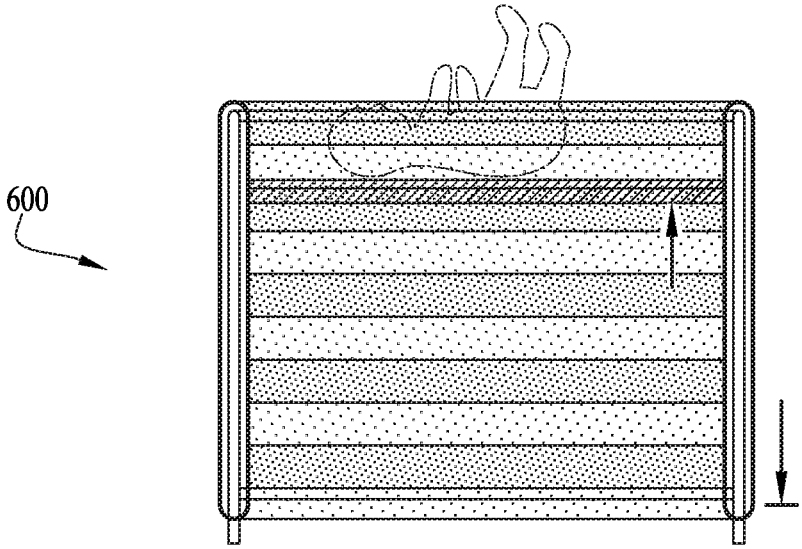
FIG. 32 is a cross-sectional view of the child enclosure of FIG. 28 configured as a diaper-changing station with the floor in a third/raised floor position.
Figure 33:
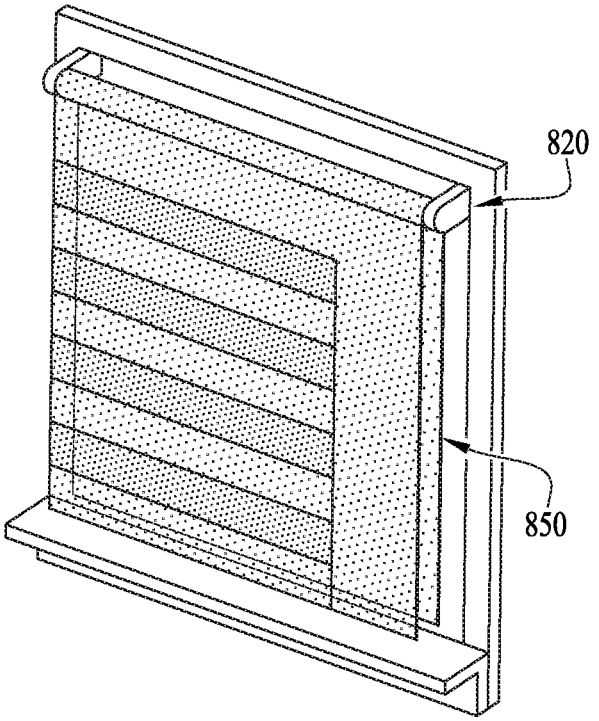
FIG. 33 is a perspective view of a computer monitor stand having an elevator height adjustment platform according to another example embodiment.

In use, pulling down on (or otherwise moving downward) an outer portion of the walls 664 causes the first end portion 665 and the connected support surface 662 to raise, and conversely pulling up on it causes the first end portion 665 and the connected support surface 662 to lower. In a typical commercial embodiment, for example, pulling down on the outer portion of the flexible wall 664 causes the first end portion 665 and the connected support surface 662 to raise from a play yard configuration with the support surface 662 in a first/lower position (FIG. 30), to a sleeper/bassinet configuration with the support surface 662 in a second/intermediate position (FIG. 31), and to a diaper-changing station configuration with the support surface 62 in a third/upper position (FIG. 32).

As such, these embodiments provide for height adjustment (e.g., raising and lowering) of a support surface by use of redirected forces (pulling down to generate upward movement, and releasing upward to generate downward movement). Various embodiments thereby solve a number of problems, for example, fewer mechanics and piece-parts results in a lower cost and easier assembly/operation, built-in fabric management avoids bunching/wrinkling, easier operation results from the frame acting as a support (or pulley) and helping the load, and the eliminated need for a lock-and-key mechanism provides infinite/user-selected positions for height adjustment. Also, in embodiments using sheer materials for the enclosure sidewalls, when the support surface is in a lowered/down position, there is only one layer of the sidewall, which allows a person outside to see inside (and vice versa); when in an intermediate-height position, there are two layers of the sidewall, which allows a child inside to be shielded from more ambient light. Further, the parent would not have to bend over to pick up baby, instead they could just push down the outer wall to raise up the baby to the parent. In addition, the various embodiments meet all regulatory requirements when used as a play yard, sleeper/bassinet, changing table, etc., for example including depth requirements, redundancies for locking mechanisms, mechanisms for coupling to a bed when in the sleeper configuration, etc. Additional features and benefits relate to keeping the support surface and contents level/horizontal while raising and lowering it, providing the right amount of resistance, securing the height once selected, and/or preventing fraying of the sidewalls.

Figure 34:
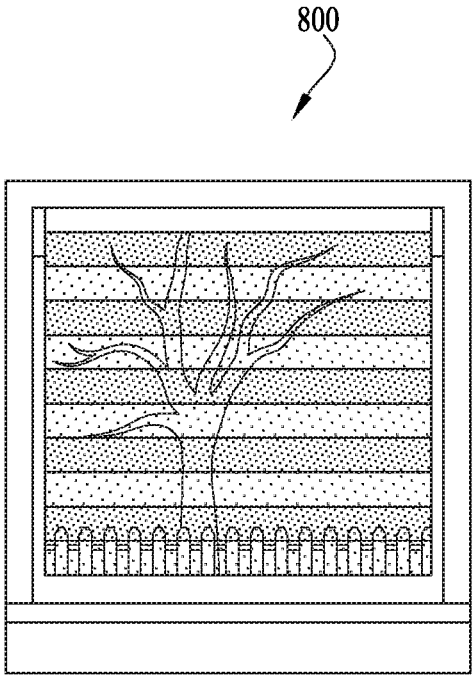
FIG. 34 is a perspective view of a window shade having an elevator height adjustment shade panel according to another example embodiment.

FIG. 34 shows a display stand 700 according to another example embodiment. The display stand 700 can have a similar design and construction as the previously described embodiments, for example it can have a structural support frame 720 and an elevator height adjusting (aka depth-adjustable) enclosure 750 supported by the frame 720. In this embodiment, however, the overlapping peripheral walls 764 of the enclosure 750 extend downward from the support surface 762 so that the support surface 762 can be used to support for example a computer monitor, a television, or another electronic device, without visual obstruction from the peripheral walls 764. As such, the enclosure 750 is inverted relative to the above-described embodiments for containing or at least storing objects (electrical wires, cable boxes, surge protectors, etc.) below the support surface 762 and hidden from outside view in at least some embodiments or configurations. In the depicted embodiment, for example, the computer monitor stand 700 can be adjustable and convertible between a lowered/stored configuration and a raised/use configuration. So the height of the computer monitor on the support surface 762 can be adjusted by moving the outer of the peripheral walls 764 up or down to cause the inner of the peripheral walls 764 and the monitor support platform 762 to move up or down, respectively. In some embodiments such as that depicted, the peripheral walls 764 are located on two opposite peripheral sides only and do not form an enclosure, and a linkage can be provided to synchronize their movement so that moving the wall at one end also moves the wall at the opposite end to raise and lower the support platform in a level orientation. Also, a lock/retainer can be provided for releasably securing the support surface 762 (directly, or indirectly by releasably securing the peripheral walls 764) in a desired one of the vertical positions, a handle can be included (e.g., on the outer of the peripheral walls 764) for manually moving the peripheral walls 764 and thus the support surface 762, and a combination lock and handle assembly can be provided in some embodiments.

Figure 35:
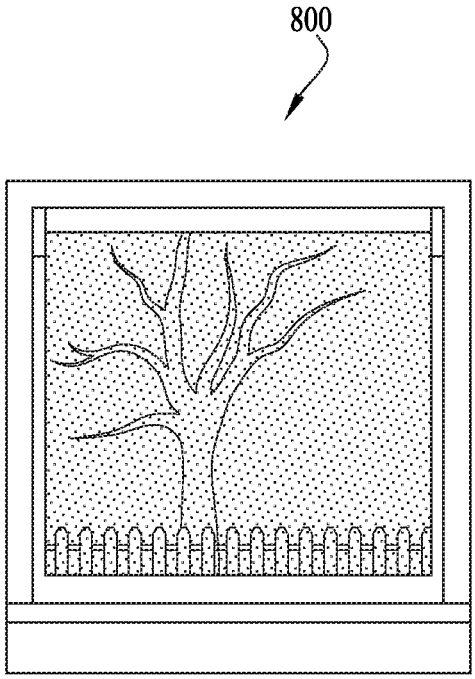
Figure 30:
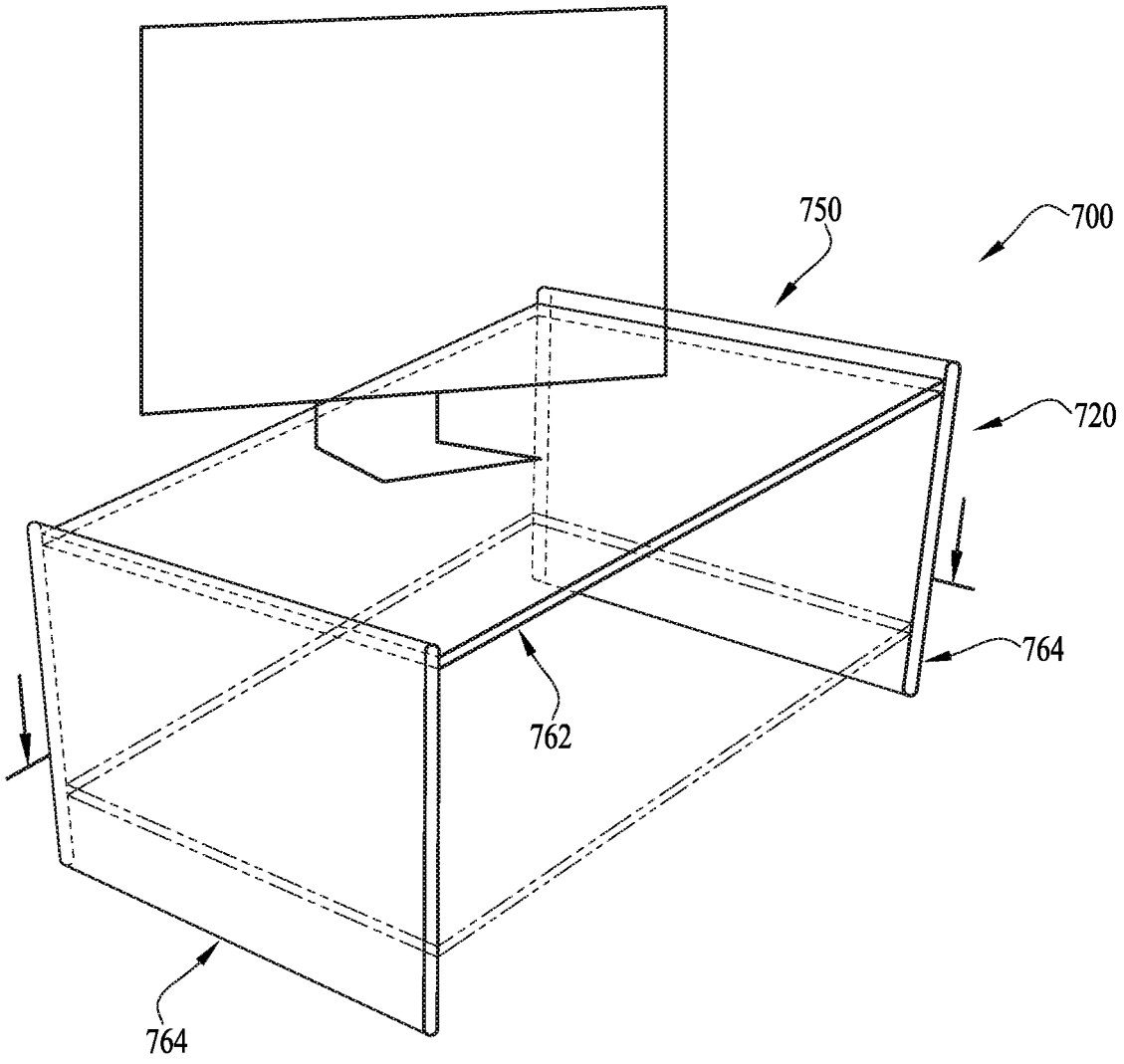

FIGS. 34-36 show a window shade device 800 according to another example embodiment. The window shade device 800 can have a somewhat similar design and construction as the previously described embodiments, for example it can have a structural support frame 820 and an elevator height adjusting (aka depth-adjustable) flexible overlapping side-wall or panel 850 supported by the frame 820. In the depicted embodiment, for example, the window shade device 800 can be adjustable and convertible between a first configuration (FIG. 35) and a second configuration (FIG. 36), with the lighting adjusted by pulling one of the overlapping shade panels 850 down causing different portions of the shade panels to overlap, for example providing more light for daytime and less light for nighttime privacy. The shade panels 850 can be for example a mesh material with horizontal bands of contrasting densities. In the first configuration (FIG. 35), lower density (more sheer) bands align/overlap to allow more light through (although at the same time higher density bands align/overlap and allow less light through them). And in the second configuration (FIG. 36), the higher density (less sheer) bands do not align/overlap (or they do so only nominally), and instead higher and lower density bands align/overlap in an alternating/staggered arrangement with no lower density band not aligned with and overlapped by a higher density band, with the overlapping shade panels together effectively providing a continuous higher density. Also, a lock/retainer can be provided for releasably securing the shade panel 850 in a desired one of the configurations, a handle can be included for manually moving the shade panel 850, and a combination lock and handle assembly can be provided in some embodiments.

Other contemplated embodiments that have an adapted form of the elevator height adjustment feature include height-adjustable platform beds, "director" chairs, cabinet shelves, tabletops, desks, entertainment centers, and curtains.

While the invention has been described with reference to preferred and example embodiments, it will be understood by those skilled in the art that a variety of modifications, additions and deletions are within the scope of the invention, as defined by the following claims.

What is claimed is:

1. A child-containment device, comprising:

a structural support frame including a plurality of peripheral upper frame members and a plurality of upright frame members supporting the peripheral upper frame members;

a depth-adjustment enclosure supported by the frame, wherein the enclosure includes a support surface and a plurality of peripheral flexible walls connected to the support surface and together defining an internal containment volume, wherein the flexible walls are routed around the upper frame members in an overlapping double-walled arrangement with each of the flexible walls having an inner wall portion within the internal containment volume and an outer wall portion outside of the internal containment volume and at least partially overlapping with the inner wall portion, and wherein the flexible walls are vertically slidable relative to the support frame to reposition/adjust the support surface to a plurality of different vertical positions forming a plurality of different configurations of the child-containment device; and a synchronization system including inter-engaging synching elements that operably link adjacent ones of the flexible walls on different sides of the child-containment device so that the linked adjacent flexible walls move and reposition together between the configurations.

2. The child-containment device of claim 1, wherein the plurality of configurations includes at least two of a play yard configuration, a bassinet/sleeper configuration, and a diaper-changing configuration.

3. The child-containment device of claim 2, wherein in the play yard configuration, the support surface is positioned at a first lowered position.

4. The child-containment device of claim 3, wherein in the bassinet/sleeper configuration, the support surface is positioned at a second position above the first position.

5. The child-containment device of claim 3, wherein in the diaper-changing configuration, the support surface is positioned at a third position higher than the first position, and wherein with the support surface in the higher third position, less of the wall remains between the support surface and the upper frame member thereby defining the inner wall portion with a smaller height than in the first configuration.

6. The child-containment device of claim 1, wherein the support surface includes a mattress.

7. The child-containment device of claim 1, wherein the flexible walls are made of a fabric material.

8. The child-containment device of claim 1, wherein the flexible walls have first end portions and second opposite end portions, with the first end portions defined by the inner wall portions and connected to the support surface, and with the second end portions defined by the outer wall portions.

9. The child-containment device of claim 1, wherein the frame includes a plurality of peripheral lower frame members parallel to the upper frame members and around which the walls are routed, and wherein the walls have first end portions and second opposite end portions both connected to the support surface to form a continuous loop with the inner wall portions and the outer wall portion overlapping along respective heights of both the inner wall portion and the outer wall portion.

10. The child-containment device of claim 1, wherein in a given one of the configurations, the inner wall portion and the connected support surface move upward in response to downward movement of the outer wall portion.

11. The child-containment device of claim 1, further comprising a locking system including inter-engaging fasteners that releasably secure the support surface in the plural configurations.

12. The child-containment device of claim 1, wherein the inter-engaging synching elements include meshing gears on adjacent ones of the upper frame members.

13. The child-containment device of claim 1, wherein the upright frame members are L-shaped with perpendicular portions extending into a space between the overlapping inner and outer wall portions of adjacent of the flexible walls to the close off any gaps between the adjacent flexible walls.

14. The child-containment device of claim 2, wherein the plurality of configurations include a first configuration with the support surface positioned at a first lowered position and second configuration with the support surface positioned at a second position higher than the first position.

15. The child-containment device of claim 14, wherein with the support surface in the higher second position, less of the flexible wall remains between the support surface and the upper frame member thereby defining the inner wall portion with a smaller height than in the first configuration.

16. A child-containment device, comprising:

a structural support frame including a plurality of peripheral upper frame members, a plurality of peripheral lower frame members that are parallel to the upper frame members, and a plurality of upright frame members extending between the upper and lower frame members; and a depth-adjustment enclosure supported by the frame, wherein the enclosure includes a support surface and a plurality of peripheral flexible walls connected to the support surface and together defining an internal containment volume, wherein the flexible walls are routed around the upper frame members and around the lower frame members in an overlapping double-walled arrangement with each of the flexible walls having an inner wall portion within the internal containment volume and an outer wall portion outside of the internal containment volume, wherein the flexible walls have first end portions and second opposite end portions both connected to the support surface to form a continuous loop with the inner wall portions and the outer wall portion overlapping along respective heights of both the inner wall portion and the outer wall portion, wherein the flexible walls are vertically slidable relative to the support frame to reposition/adjust the support surface to a plurality of different vertical positions forming a plurality of different configurations of the child-containment device, and wherein in a given one of the configurations the inner wall portion and the connected support surface move upward in response to downward movement of the outer wall portion, and wherein the depth-adjustment enclosure includes a synchronization system including inter-engaging synching elements that mechanically link adjacent ones of the flexible walls on different sides of the child-containment device so that the linked adjacent walls move and reposition together between the plural configurations.

17. The child-containment device of claim 16, wherein the plurality of configurations include at least two of a play yard configuration, a bassinet/sleeper configuration, and a diaper-changing configuration, wherein the plurality of configurations include a first configuration with the support surface positioned at a first lowered position and second configuration with the support surface positioned at a second position higher than the first position, and wherein with the support surface in the higher second position, less of the wall remains between the support surface and the upper frame member thereby defining the inner wall portion with a smaller height than in the first configuration.

* * * * *